US011071425B2

(12) United States Patent
Westbrook

(10) Patent No.: US 11,071,425 B2
(45) Date of Patent: Jul. 27, 2021

(54) WIDE-AREA VACUUM NOZZLE

(71) Applicant: SHOP VAC CORPORATION, Williamsport, PA (US)

(72) Inventor: Kurt Westbrook, Cogan Station, PA (US)

(73) Assignee: SHOP VAC CORPORATION, Williamsport, PA (US)

( * ) Notice: Subject to any disclaimer, the term of this patent is extended or adjusted under 35 U.S.C. 154(b) by 199 days.

(21) Appl. No.: 16/107,870

(22) Filed: Aug. 21, 2018

(65) Prior Publication Data

US 2019/0059669 A1 Feb. 28, 2019

Related U.S. Application Data

(60) Provisional application No. 62/551,342, filed on Aug. 29, 2017.

(51) Int. Cl.
*A47L 9/06* (2006.01)

(52) U.S. Cl.
CPC ..... *A47L 9/0693* (2013.01)

(58) Field of Classification Search
CPC ..... A47L 9/0693
See application file for complete search history.

(56) References Cited

U.S. PATENT DOCUMENTS 2,056,850 A * 10/1936 Goughnour ..... A47L 9/02 15/420
2,554,238 A * 5/1951 Burri ..... A47L 9/02 15/401
2,860,367 A * 11/1958 Kolenda ..... A47L 9/02 15/393
4,498,206 A * 2/1985 Braukmann ..... E04H 4/1636 15/1.7
4,638,527 A * 1/1987 Fleischhauer ..... A47L 9/06 15/371

(Continued)

FOREIGN PATENT DOCUMENTS

DE 648771 C 8/1937
DE 9403166 U1 5/1994

(Continued)

OTHER PUBLICATIONS

International Application No. PCT/US2018/047311, Invitation to Pay Additional Fees and Partial International Search, dated Nov. 21, 2018.

(Continued)

*Primary Examiner* — Marc Carlson
(74) *Attorney, Agent, or Firm* — Marshall, Gerstein & Borun LLP

(57) ABSTRACT

A wide-area vacuum nozzle includes a body having a first surface, a second surface, a leading edge, and a trailing edge, where the leading edge and trailing edge form an outer periphery of the body. The outer periphery includes a first juncture and a second juncture disposed between the leading edge and the trailing edge. An aperture formed through the first surface and second surface of the body is disposed between the leading edge and the trailing edge. A fitting is connected to the aperture and adapted for connection to vacuum source. The leading edge forms an arc extending between the first juncture and the second juncture.

53 Claims, 16 Drawing Sheets

(56) References Cited

U.S. PATENT DOCUMENTS 5,032,184 A * 7/1991 Ogilvie ..... A47L 5/38 134/21
5,343,591 A * 9/1994 Clark ..... A47L 11/00 15/321
5,347,679 A * 9/1994 Saunders ..... A47L 5/28 15/329
5,349,722 A * 9/1994 Chayer ..... A47L 7/0009 15/245
5,354,347 A 10/1994 McCoy et al.
5,437,651 A * 8/1995 Todd ..... A61M 1/0088 15/420
5,839,157 A 11/1998 Strauser et al.
6,094,767 A 8/2000 Iimura
6,105,207 A * 8/2000 Muller ..... A47L 9/02 15/415.1
6,136,098 A * 10/2000 Tribastone ..... A47L 7/0009 134/21
6,240,596 B1 6/2001 Kiern
6,430,773 B1 * 8/2002 Buron ..... A47L 9/02 15/420
6,584,640 B2 7/2003 Vanderlinden
7,137,170 B1 11/2006 Morey et al.
7,162,771 B2 1/2007 Grosze et al.
7,293,327 B2 11/2007 Tagliaferri
7,370,390 B1 * 5/2008 Muller ..... A47L 9/02 15/415.1
7,467,439 B2 * 12/2008 Lijzenga ..... A47L 9/02 15/355
7,676,886 B2 3/2010 Kim
D629,982 S * 12/2010 Rossano ..... D32/33
8,108,965 B1 2/2012 Reimnitz
8,245,890 B2 * 8/2012 Koch ..... F04D 29/708 222/464.1
D681,897 S * 5/2013 Bruneel ..... D32/33
8,769,768 B2 7/2014 Laliberté et al.
8,966,705 B2 3/2015 Laliberté et al.
D754,938 S * 4/2016 Bruneel ..... D32/33
9,301,661 B2 * 4/2016 Venard ..... A47L 9/009
9,408,511 B2 8/2016 Vanderlinden
9,451,854 B2 * 9/2016 Diminick ..... A47L 9/0613
9,615,706 B1 * 4/2017 Siegel ..... B08B 5/04
9,861,243 B1 * 1/2018 Caldwell ..... A47L 9/0693
9,877,624 B2 * 1/2018 Venard ..... A47L 9/325
9,877,625 B2 * 1/2018 Venard ..... A47L 7/0009
D809,721 S * 2/2018 Venard ..... D32/15
10,188,250 B2 * 1/2019 Venard ..... A47L 11/4088
D845,569 S * 4/2019 Carriere ..... D32/32
2003/0229964 A1 * 12/2003 Thomason ..... A47L 5/28 15/353
2006/0265820 A1 * 11/2006 Erlich ..... E04H 4/1636 15/1.7
2010/0252136 A1 10/2010 Koch
2014/0041146 A1 * 2/2014 Venard ..... A47L 9/009 15/320

FOREIGN PATENT DOCUMENTS

DE 29813717 U1 11/1998
GB 600236 A 4/1948
GB 2447338 A 9/2008

OTHER PUBLICATIONS

International Application No. PCT/US2018/047311, International Search Report and Written Opinion, dated Mar. 8, 2019.

* cited by examiner

WIDE-AREA VACUUM NOZZLE

FIELD OF DISCLOSURE

The present disclosure generally relates to a nozzle for a vacuum cleaner, and specifically, to a wide-area vacuum nozzle.

BACKGROUND

A vacuum nozzle for a vacuum cleaner can have a specific range of air flow distribution and a body that is shaped for a specific cleaning function. An operator of the vacuum cleaner may have multiple nozzles for a single vacuum cleaner where each nozzle may be attached to a vacuum hose or adapter to perform a specific cleaning function, and then removed and replaced with a different nozzle for a different cleaning function. Because each nozzle is designed to address a particular function or cleaning need, the body of a nozzle is generally shaped according to the cleaning job or for the specific target cleaning surface. For example, a nozzle may be a flattened tube with a highly concentrated narrow intake orifice that is useful to pick up heavy objects and to reach small areas in narrow spaces. In another example, a typical vacuum cleaner nozzle has a wide, rectangular body to cover large target areas. The typical vacuum cleaner is operated by moving the nozzle head backward and forward repeatedly over the same cleaning surface until the target cleaning surface is clear.

Inconvenient, yet common cleaning jobs re cleaning corners, crevices, and large target areas located underneath furniture and adjacent walls. The typical rectangular vacuum cleaner nozzle may not provide enough suction at the sides of the nozzle body to clean near walls or near vertical surfaces without changing the orientation of the nozzle relative to the target cleaning area. This is because the hose or wand is connected at the center of the nozzle, so air is drawn in through the middle of the nozzle more easily than air is drawn near the outer edges of the nozzle. To address this, divider walls may be placed in the interior of the nozzle to direct more suction towards the outer edges. Divider walls, however, may reduce overall suction and may increase likelihood that debris becomes lodged in the nozzle. Therefore, in some cases, the air distribution of the nozzle cannot adequately reach certain areas without contacting furniture or walls.

Additionally, the nozzle body of the typical vacuum cleaner is generally too tall to fit under furniture. Instead, an operator may have to lift and rearrange large and heavy furniture to reach the target surface areas. If the furniture cannot be moved, an operator may replace the typical vacuum nozzle with a narrow nozzle to reach underneath the furniture. While a narrow nozzle may fit within tight spaces and the concentrated suction force of the intake orifice may pick up heavy objects, the small intake orifice of the wand may not distribute air flow beyond its intake orifice to allow an operator to clean a wide target area efficiently. These particularly difficult cleaning jobs (e.g., cleaning near walls and under furniture) may add significant time to cleaning and often require an operator to either work with a tool having a small air distribution range, or lift and remove heavy and bulky pieces of furniture before resuming cleaning.

SUMMARY

In accordance with a first exemplary aspect of the present disclosure, a wide-area vacuum nozzle may include a body having a first surface, a second surface, a leading edge, and a trailing edge, where the leading edge and trailing edge may at least partially define an outer periphery of the body. The body may include a first juncture and a second juncture disposed between the leading edge and the trailing edge. An aperture may be formed through the first surface and second surface of the body and may be disposed between the leading edge and the trailing edge. A fitting may be connected to the aperture and may be adapted for connection to a vacuum source. The leading edge may define an arc extending between the first juncture and the second juncture.

In accordance with a second exemplary aspect of the present disclosure, a wide-area vacuum nozzle may include a body having a first surface, a second surface, a leading edge, and a trailing edge. The leading edge and trailing edge may at least partially define an outer periphery of the body, in which the outer periphery may include a first juncture and a second juncture disposed between the leading edge and the trailing edge. An aperture may be formed through the first surface and second surface of the body and may be disposed between the leading edge and the trailing edge. A back wall of may be operatively coupled to the trailing edge and may be perpendicularly oriented relative to the body. The back wall may extend beyond the second surface of the body to contact a cleaning surface.

In accordance with a third exemplary aspect of the present disclosure, a wide-area vacuum nozzle and bracket assembly for coupling to a vacuum cleaner tank may include a nozzle having a flat body with a first surface, a second surface, a leading edge, and a trailing edge. The leading edge and the trailing edge may at least partially define an outer periphery of the body. The outer periphery may include a first juncture and a second juncture to disposed between the leading edge and the trailing edge. An aperture may be disposed between the leading edge and the trailing edge and extending through the first surface and second surface of the body. A bracket may have a first end and a second end, where the first end may be hingedly coupled to the nozzle and the second end may be spaced away from the nozzle. The bracket may be oriented at an angle relative to the body of the nozzle.

In accordance with a fourth exemplary aspect of the present disclosure, a wide-area vacuum nozzle may include a generally horizontal plate having a leading edge and a trailing edge, wherein (i) each of the trailing edge and leading edge may have a midpoint, a left side and a right side; (ii) a left intersection disposed between the left sides of the leading edge and trailing edge; and (iii) a right intersection disposed between the right sides of the leading edge and the trailing edge. An aperture through the plate may be proximate to the midpoint of the trailing edge, wherein the aperture may be adapted to connect to a vacuum source. The aperture may be (a) approximately equidistant from the left intersection and the right intersection, and (a) further than or equidistant from the midpoint of the leading edge as it is from the right intersection and left intersection.

In further accordance with any one or more of the foregoing first, second, third, and fourth exemplary aspects, a wide-area vacuum nozzle or a wide-area vacuum nozzle and bracket assembly may include any one or more of the following preferred forms.

In one preferred form, the outer periphery of the body may be a fan shape and the aperture may be positioned adjacent a bend of the trailing edge.

In another preferred form, the body may be transparent.

In another preferred form, the body may be a plate and the first surface and second surface of the plate are parallel.

In another preferred form, the nozzle may include a back wall operatively coupled to the trailing edge of the body and oriented perpendicularly relative to the body.

In another preferred form, the durable material of back wall may be an ultra-high molecular weight polyethylene.

In another preferred form, the back wall may extend in a perpendicular direction beyond the second surface of the body to contact a cleaning surface.

In another preferred form, the back wall may extend beyond the second surface of the body a distance D, where distance D may be in a range of approximately 0.25 inches to approximately 1 inch.

In another preferred form, the back wall may include an outwardly extending flange angled relative to the back wall.

In another preferred form, the wall may include a first segment and a second segment connected to the first segment, wherein each of the first and second segments connects to form an angle near the midpoint of the trailing edge.

In another preferred form, the wall may be a material having a low coefficient of friction.

In another preferred form, a midpoint of the arc of the leading edge may be a first distance from a centerpoint of the aperture, the first juncture may be a second distance from the centerpoint of the aperture, and the second juncture may be a third distance from the centerpoint of the aperture. The second distance may be approximately equal to the third distance.

In another preferred form, the first distance may be greater than or equal to each of the second distance and the third distance.

In another preferred form, a distance between the first juncture and the second juncture may be in a range of approximately 10 inches to approximately 30 inches.

In another preferred form, the wide-area vacuum nozzle may include a fitting sealably coupled to the first surface of the body and surrounding the aperture formed in the first surface.

In another preferred form, the fitting may be centered about a fitting axis extending from the first surface of the body, the fitting axis disposed at an angle relative to the first surface of the body.

In another preferred form, the fitting may be operatively coupled to the body between the first juncture and the second juncture and adjacent to the bend of the trailing edge.

In another preferred form, the angle of the fitting axis relative to the first surface of the body may be in a range of approximately 90 degrees to approximately 180 degrees.

In another preferred form, the wide-area vacuum nozzle may include a bracket assembly operatively coupled to the body of the nozzle. The bracket assembly may include a bracket hingedly coupled to the body, and extending from the first surface of the body at an angle.

In another preferred form, the wide-area vacuum nozzle may include a bracket assembly having a bracket with a first end and a second end, the first end of the bracket hingedly coupled to a first surface of the plate and the second end of the bracket adapted to couple to an outer surface of a vacuum cleaner tank, wherein the bracket assembly may be oriented at an angle relative to the plate.

In another preferred form, the bracket assembly may be disposed at an angle relative to the body, wherein the angle of the bracket assembly may be adjustable.

In another preferred form, the bracket assembly may be removably coupled to the body.

In another preferred form, the peripheral leading edge may be a circular arc.

In another preferred form, the peripheral leading edge may be an elliptical arc.

In another preferred form, the leading edge and the trailing edge of the body may meet at the first juncture and the second juncture.

In another preferred form, the wide-area vacuum nozzle may include a spacer extending away from the second surface of the body. The spacer may be adapted to separate the second surface of the body from a cleaning surface.

In another preferred form, the leading edge may define an arc extending between the first juncture and the second juncture and the trailing edge may define a bend between the first juncture and the second juncture.

In another preferred form, the back wall may be integrally formed with the trailing edge.

In another preferred form, the back wall includes an outwardly extending flange.

In another preferred form, a fitting may be sealably coupled to the first surface of the body and surrounding the aperture formed in the first surface.

In another preferred form, a hose connector may have a first end and a second end where the first end may be fluidly coupled to the fitting. A bracket fitting may be coupled to the second end of the bracket and coupled to the second end of the hose connector. The bracket fitting may define an opening sized to receive the hose connector.

In another preferred form, the bracket fitting may be hingedly coupled to the second end of the bracket.

In another preferred form, the back wall may be at least one of a rubber, acetal, Acrylonitrile-Butadiene-Styrene, and a brush material.

BRIEF DESCRIPTION OF THE DRAWINGS

The disclosure may be best understood by reference to the following description taken in conjunction with the accompanying drawings, in which.

DETAILED DESCRIPTION

Figure 1:
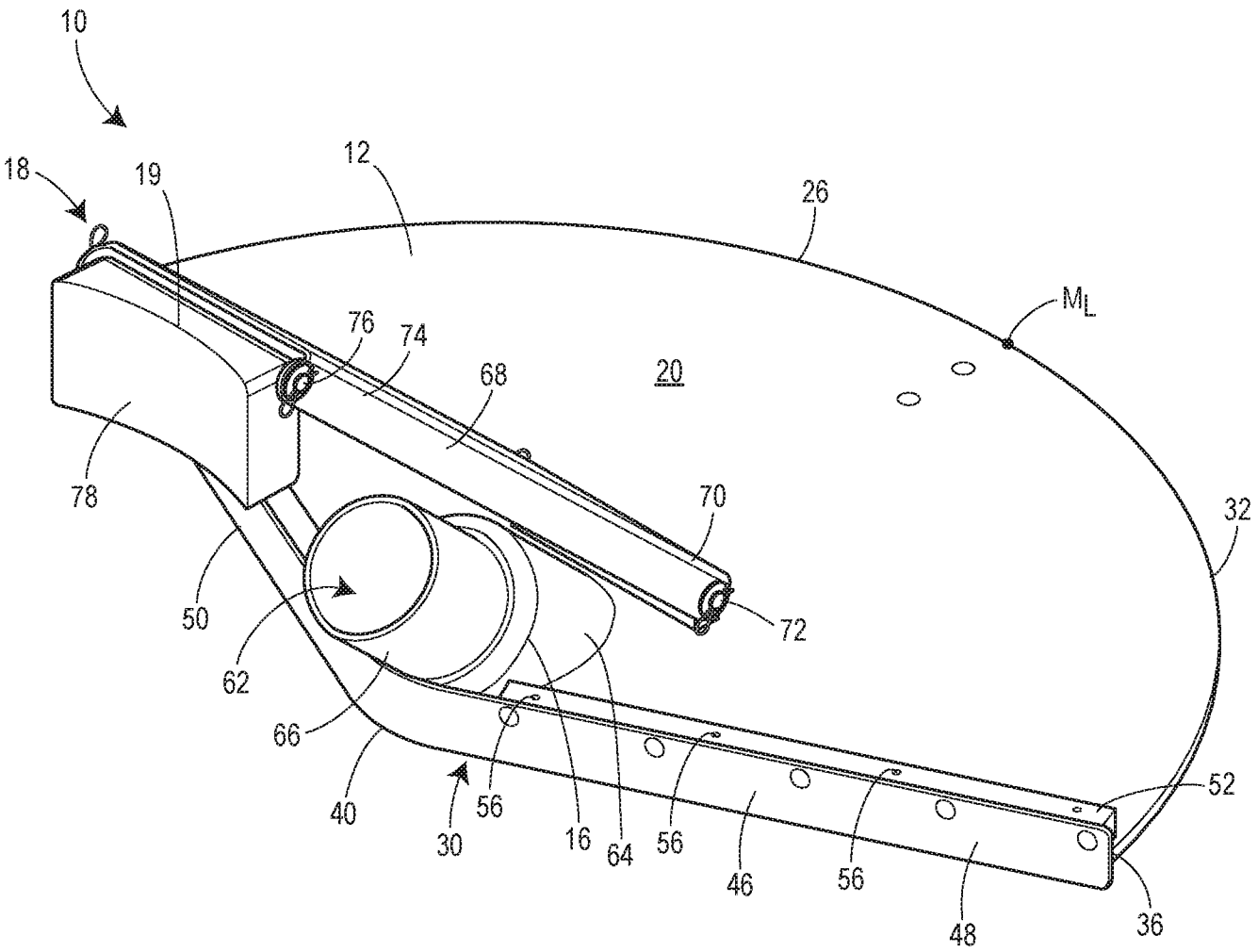
FIG. 1 is a perspective view of a first exemplary wide-area vacuum nozzle and a first exemplary bracket assembly for use with a vacuum cleaner assembled in accordance with the teachings of the present disclosure.

Although the following text sets forth a detailed description of one or more examples of the disclosure, it should be understood that the legal scope of the disclosure is defined by the claims at the end of this patent. The following detailed description is to be construed as exemplary only and does not describe every possible example of the disclosure, as describing every possible example would be impractical, if not impossible. Numerous alternative examples could be implemented, using either current technology or technology developed after the filing date of this patent, and such alternative examples would still fall within the scope of the claims defining the disclosure.

A wide-area vacuum nozzle according to the present disclosure is shaped to move alongside walls and fit beneath furniture and to provide substantially uniform airflow characteristics along a wide-area inlet or leading edge. FIGS. 1-5 illustrate a first exemplary nozzle 10 constructed in accordance with the teachings of the present disclosure. The nozzle 10 is adapted to connect to a vacuum source via a hose, wand, or an adapter of a vacuum cleaner, and may be used with different types and sizes of vacuum cleaners, wands, hoses, and/or adapters.

As shown in FIGS. 1-5, the nozzle 10 has a generally horizontal body 12, an aperture 14 formed through the body 12, and a fitting 16 surrounding the aperture 14 and adapted to connect to a vacuum source. The body 12 of the nozzle 10 is transparent so that an operator may view a cleaning surface through the body 12 while operating the nozzle 10 directly over the cleaning surface. In the illustrated example, a bracket assembly 18 is hingedly coupled to the body 12 of the nozzle 10 and may be used to connect a vacuum cleaner tank or wheeled vacuum cart to the nozzle 10. The bracket assembly 18, which includes a tank fitting 19, is an optional component, and may be removed and stored when the fitting is not used. In other examples, the nozzle 10 is attached to a vacuum source without the bracket assembly 18 or includes additional components or a different bracket assembly for adapting the nozzle 10 for use with a vacuum source.

Figure 2:
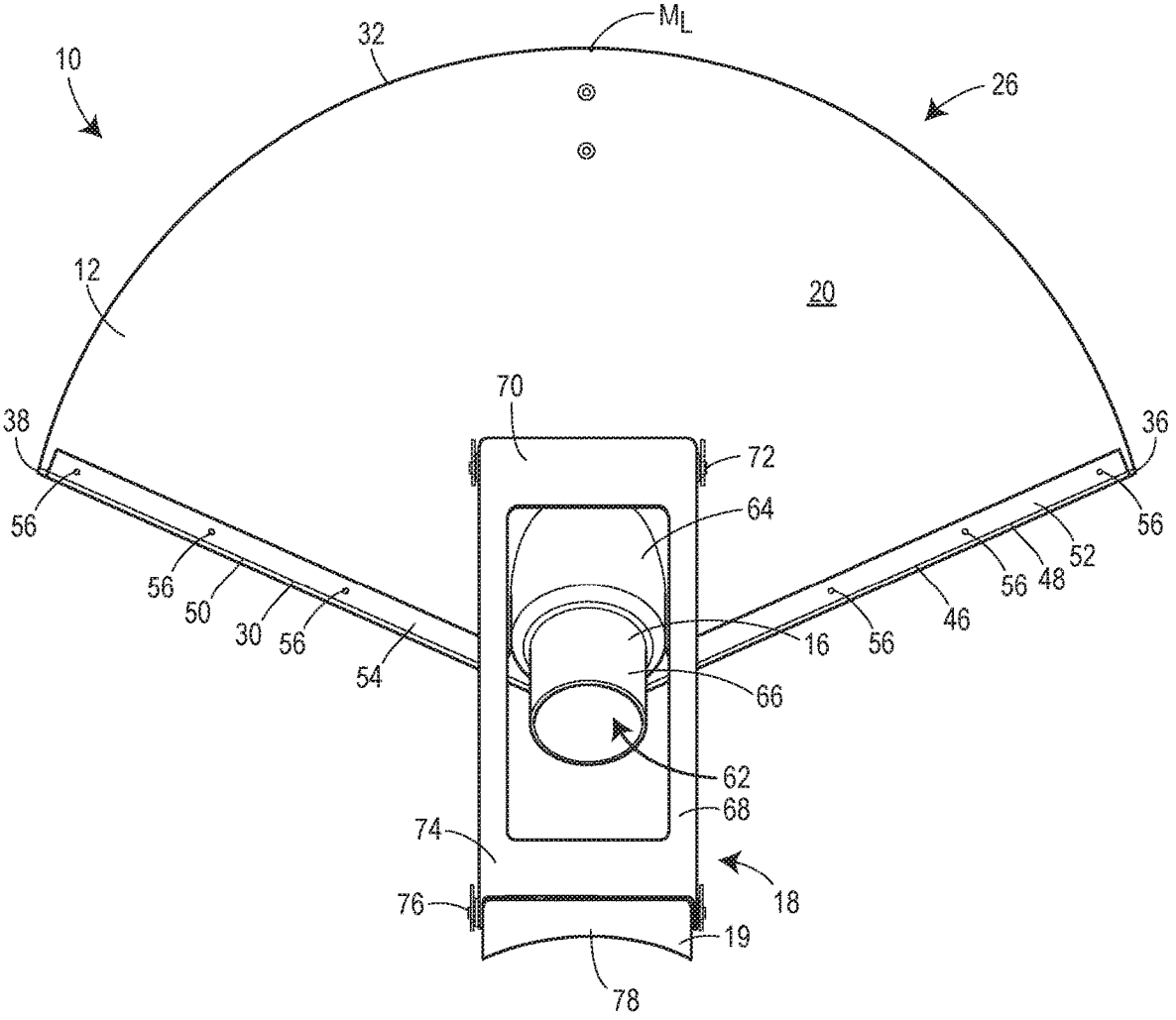
FIG. 2 is a top view of the nozzle of FIG. 1.
Figure 3:
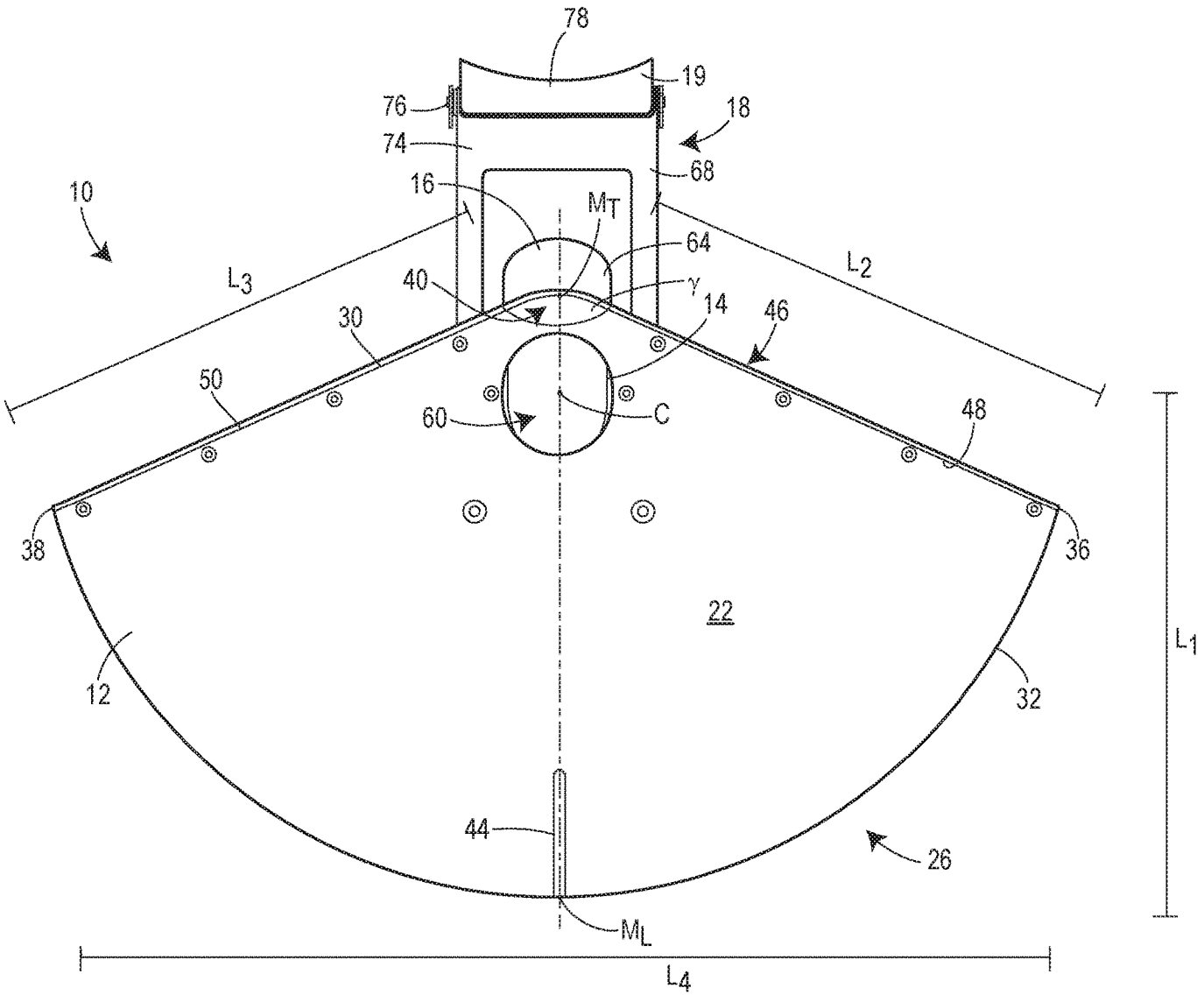
FIG. 3 is a bottom view of the nozzle of FIG. 1.

In FIGS. 1-5, the body 12 of the nozzle 10 is generally a flat plate having a first surface 20, a second surface 22, a leading edge 26 (also referred herein as an inlet edge), and a trailing edge 30. The leading edge 26 and the trailing edge 30 meet in two locations and together define an outer periphery 32 of the body 12. The leading edge 26 meets the trailing edge 30 at a first juncture 36 and at a second juncture 38 (also referred herein as a first/second or right/left intersections), which is shown in FIGS. 2 and 3. The leading edge 26 forms an arc extending between the first juncture 36 and the second juncture 38, and the trailing edge 30 forms a bend 40 at a midpoint $M_T$ (FIG. 3) between the first juncture 36 and the second juncture 38. The bend 40 is formed by right and left portions 48, 50 of the trailing edge 30 that meet at the midpoint $M_T$ and form an angle $\gamma$. In the illustrated example, the body 12 of the nozzle 10 is shaped like a fan to distribute airflow across the leading edge 26 between the first juncture 36 and the second juncture 38. In other examples, however, the body 12 of the nozzle 10 may have a different shape. For example, a nozzle may include a rectangular leading edge (e.g., FIG. 6) or an elliptical arc-shaped leading edge (e.g., FIG. 7). The trailing edge 30 may have a different shape as well, such as, for example, the bend 40 in the trailing edge 30 may have a U-shape or a V-shape bend where the angle $\gamma$ may be obtuse or acute. Additionally, other examples may include intermediate segments of the outer periphery that connect the leading edge 26 and the trailing edge 30.

As best shown in FIG. 3, the aperture 14 is formed through the first and second surfaces 20 and 22 of the body 12 and spaced between the midpoints $M_L$ and $M_T$ of the leading edge 26 and the trailing edge 30. More specifically, a centerpoint C of the aperture 14 is disposed inwardly from the trailing edge 30 and is aligned with the midpoint $M_L$ of the leading edge 26 and the midpoint $M_T$ of the trailing edge 30. As a result, the centerpoint C of the aperture 14 is approximately equidistant from the first juncture 36 and the second juncture 38. Due to the circular geometry of the leading edge 26 and the placement of the aperture 14, the airflow distribution at the midpoint $M_L$ of the leading edge 26 is the same or substantially similar as the air flow distribution at each of the first and second junctures 36 and 38 of the body 12. This effect is achieved when a length $L_1$ extending between the midpoint $M_L$ of the leading edge 26 and the centerpoint C of the aperture 14 is approximately the same or greater than a length $L_2$ extending between the centerpoint C of the aperture 14 and the first juncture 36 and a length $L_3$ extending between the centerpoint C and the second juncture 38. In the illustrated example, lengths $L_2$ and $L_3$ are equal, and each of lengths $L_2$ and $L_3$ may be substantially equal to length $L_1$. So configured, when the nozzle 10 is coupled (e.g., directly or indirectly attached, secured, or connected) to a vacuum source, the air flow suction force at each of the first juncture 36 and the second juncture 38 is approximately equal to the air flow suction force at the midpoint $M_L$ of the leading edge 26 and each point along the arc-shaped leading edge 26 between the first and second junctures 36 and 38. In other words, the air distribution at the right and left sides of the leading edge 26 (i.e. the portions of the leading edge 26 between the first juncture 36 and the midpoint $M_L$ and the second juncture 38 and the midpoint $M_L$) can pull debris inward towards the aperture 14 (or intake orifice) with approximately the same amount of suction. In other examples, the length $L_1$ may be greater than each of lengths $L_2$ and $L_3$, and/or the centerpoint C of the aperture 14 may not be aligned with the midpoints $M_L$ and $M_T$ of the leading edge 26 and the trailing edge 30, and may be instead disposed closer to one of the two junctures 36 and 38 to achieve different air flow characteristics. As a result, the lengths $L_2$ and $L_3$ may not be equal in such examples.

In any of these examples and combinations of example nozzles, the body 12 may be manufactured from any suitable material, but is preferably formed from an extrudable material including, but not limited to, extrudable polymers and metals. Exemplary extrudable plastics include, but are not limited to, polyvinylchlorides, polyethylenes, polypropylenes, acetals, acrylics, nylons (polyamides), polystyrene, acrylonitrile butadiene styrenes, and polycarbonates. The body 12 is preferably made of a transparent and durable plastic, such as polyethylene, that may be formed by injection molding, thermoforming, or compression molding. The body 12 may instead be formed of any other suitable and durable material including metal, fiberglass, or other similar materials, or any combination of these materials. The nozzle body 12 is also preferably transparent so that an operator may see debris underneath the body 12 and direct the nozzle 10 to target certain debris or areas of the cleaning surface. However, in other examples, the nozzle 10 may be translucent or opaque. The body 12 is preferably 0.25 inches thick and a length $L_4$ extending between the first juncture 36 and the second juncture 38 may be in a range from approximately 10 inches to approximately 30 inches, depending on the application of the nozzle 10. For example, for a small work surface, the length $L_4$ may be approximately 10 inches, and for a workshop floor, the length $L_4$ may be approximately 24 inches or more. In the illustrated example, the aperture 14 is an elliptical shape, however in other examples, the aperture 14 may be circular.

Figure 4:
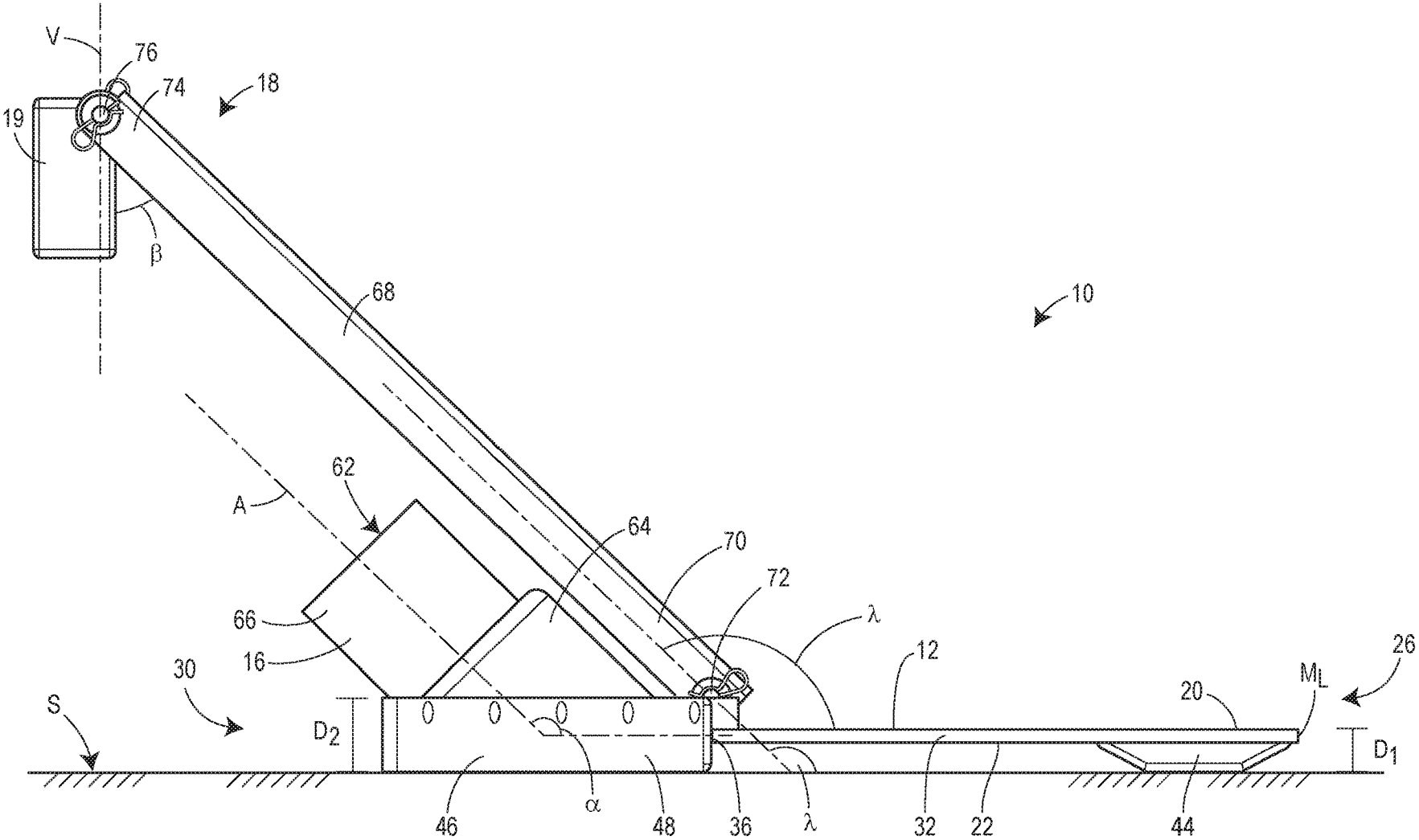
FIG. 4 is a side view of the nozzle of FIG. 1, where the nozzle is in contact with a horizontal cleaning surface.

As shown in FIG. 4, the first surface 20 and the second surface 22 are generally flat and parallel, providing a low-profile nozzle 10 capable of hovering close to a cleaning surface and also fitting within narrow spaces. The body 12 is disposed generally parallel to a horizontal surface S, however, in other examples, the first surface 20 and the second surface 22 may not be parallel. Instead, the body 12 may be contoured such that the nozzle 10 has a curved surface relative to the horizontal cleaning surface S. In another example, the body 12 may be slightly convex so that the outer periphery 32 of the body 12 is angled slightly away from the horizontal cleaning surface S. In these examples, the body 12 may be shaped to promote air flow distribution at each point around the inlet or leading edge 26 of the nozzle 10, or achieve other desirable air distribution characteristics. Other example nozzles 10 may include ribs, channels, grooves, dimples, knobs, bumps, or any combination thereof that are provided in the first surface 20 and/or second surface 22 of the body 12 to enhance air flow distribution in some or all regions of the leading edge 26 of the body 12.

The nozzle 10 further includes a spacer 44 disposed at the midpoint $M_L$ of the leading edge 26 and that spaces the body 12 away from the horizontal cleaning surface S. The spacer 44 is coupled (e.g., fixed, connected, and/or attached) to the second surface 22 of the body 12 and extends away and below the second surface 22 to meet the cleaning surface S. The spacer 44 may be a guiding peg or piece of durable material to facilitate movement of the nozzle 10 over the cleaning surface S. The spacer 44 is adapted to separate the second surface 22 of the body 12 from the cleaning surface S so that the body 12 floats above the cleaning surface S when the nozzle 10 is in use. The spacer 44 raises the leading edge 26 of the nozzle 10 so that when the nozzle 10 slides across the cleaning surface S, the nozzle 10 may smoothly glide over any changes in elevation or floor conditions, such as an incline or an obstruction, without catching the leading surface 26 on the incline or obstruction. The spacer 44 raises the midpoint $M_L$ (and the body 12) a distance $D_1$ above the horizontal surface S, and a back wall 46 operatively coupled to the trailing edge 30 of the body 12 extends past the second surface 22 of the body 12 a distance $D_2$. Each of the back wall 46 and the spacer 44 preferably extends beyond (and below) the second surface 22 of the body 12 a distance in a range of approximately 0.25 inches to approximately 1 inch. In this example, $D_1$ and $D_2$ may be equal or approximately equal. In other examples, however, $D_1$ and $D_2$ may be different to provide an incline relative to the horizontal surface S, where $D_1$ is greater than $D_2$, or decline relative to the horizontal surface S, where $D_2$ is greater than $D_1$. The spacer 44 may be made of the same or similar material as the back wall 46 and to promote gliding on a cleaning surface S. In other examples, the spacer 44 may be integrally formed with the body 12 of the nozzle 10.

The back wall 46 of the nozzle 10 is configured to separate the body 12 and the cleaning surface S, trap debris under the body 12, and direct debris toward the intake orifice 14. As shown in FIGS. 1-5, the back wall 46 is operatively coupled (e.g., attached, fastened, welded, affixed, integrated) to the trailing edge 30 of the body 12. The back wall 46 is made of a durable and highly resistant (e.g., wear, abrasion, and impact resistant) material, and at least a portion of the back wall 46 extends below the second surface 22 of the body 12 of the nozzle 10 to contact the cleaning surface S. The back wall 46 is oriented perpendicularly relative to the generally flat body 12 of the nozzle 10, and is shaped to match or fit against a portion of the outer periphery 32 of the trailing edge 30. The back wall 46 includes a first segment 48 and a second segment 50 (also referred herein as right/left portions) connected to the first segment 48 adjacent the midpoint $M_T$ of the trailing edge 30. The first and second segments 48 and 50 form a continuous ground-engaging barrier that gathers debris entering the leading edge 26 of the nozzle 10 that is not pulled into the aperture by its suction, and traps the debris beneath the second surface 22 of the body 12. In other words, the back wall 46 sweeps debris from each side of the aperture 14 by keeping any debris in the path of the nozzle 10 in front of the trailing edge 30, and directing the debris towards the aperture 14 as the nozzle 10 moves forward. The first and second segments 48 and 50 extend from the midpoint $M_T$ of the trailing edge 30 at an angle $\gamma$ defined by the bend 40, forming an angled back wall 46. The angled back wall 46 helps direct debris, such as, for example, heavy dirt or objects, located near the outer periphery 32 of the inlet edge 26 toward the aperture 14 where the force of suction is greater. For example, as the nozzle 10 moves in a forward direction (i.e., in the direction forward relative to the leading edge 26) and over heavy debris, any debris that is not immediately drawn into the aperture 14 and located near the outer periphery 32 may roll against the first or second segments 48 and 50 of the angled back wall 46 toward the aperture 14.

As shown in FIGS. 1 and 2, the back wall 46 is connected to the trailing edge 30 of the body 12 by one or more brackets 52 and 54 and a plurality of fasteners 56. One bracket 52 attaches the right segment 48 of the back wall 46 to the body 12, and another bracket 54 attaches the left segment 50 of the back wall 46 to the body 12. In other examples, the back wall 46 may be directly attached to the trailing edge 30, the first surface 20, and/or the second surface 22 of the body 12 by adhesive, bolts, clamps, or other suitable fastening devices. The back wall 46 and the spacer 44 may be an ultra-high molecular weight (UHMW) polyethylene or polyurethane, rubber, acetal, Acrylonitrile-Butadiene-Styrene (ABS), or brush material. In some examples, the back wall 46 may be any suitable material having a low coefficient of friction that promotes sliding the nozzle 10 over a cleaning surface. In this way, both the spacer 44 and the back wall 46 facilitate moving the nozzle 10 along the cleaning surface S.

Turning back to FIG. 1, the fitting 16 of the nozzle 10 has an inlet 60 and an outlet 62, where the inlet 60 surrounds the aperture 14 formed in the first surface 20 of the body 12 and the outlet 62 is spaced away from the body 12 and is adapted to couple the nozzle 10 to a vacuum hose or wand. As shown in FIG. 4, the fitting 16 is centered about a fitting axis A and extends from the first surface 20 of the body 12 at an angle α relative to a planar (or substantially planar) first surface 20 of the body 12. The angle α may be in a range from approximately 90 degrees relative to the first surface 20 of the body 12 and/or horizontal surface S to approximately 180 degrees relative to the first surface 20 of the body 12 and/or horizontal surface S. In a preferred example, the fitting angle α is approximately 135 degrees relative to the body 12 and/or the horizontal surface S. The angle α in this example allows the nozzle 10 to pick up lengthy debris without getting caught in the fitting 16. The angle α is also effective for using wands connected to the fitting 16 as a convenient handle for directing the nozzle 10 over a cleaning surface.

The fitting 16 includes a first cylindrical portion 64 and a second cylindrical portion 66. The first portion 64 at least partially defines the inlet 60 of the fitting 16 and is operatively coupled (e.g. directly or indirectly attached, secured, and/or connected) to the first surface 20 of the nozzle body 12. More specifically, the fitting 16 may be sealably coupled to the first surface 20 of the body 12 so that the aperture 14 and the fitting 16 are in fluid communication. In other examples, the first portion 64 of the fitting 16 may be shaped to fit within the aperture 14 of the body 12 and to sealably engage an interior wall of the aperture 14 by a friction-fit. The second portion 66 of the fitting 16 is coupled to the first portion 64 and at least partially defines the outlet end 62 of the fitting 16. As shown in FIG. 3, the inlet 60 of the fitting 16 forms an elliptical cross-section at the first surface 20 of the body 12 to mate with or substantially surround an elliptical shape of the aperture 14. As shown in FIG. 1, the outlet 62 of the fitting 16 may be a universal fitting with a circular cross-sectional area to receive, or sized to fit within, a typical vacuum hose or hose adapter. Either or both portions 64 and 66 may have a grip disposed on an exterior surface of the fitting 16 to facilitate manual operation of the nozzle 10.

Figure 5:
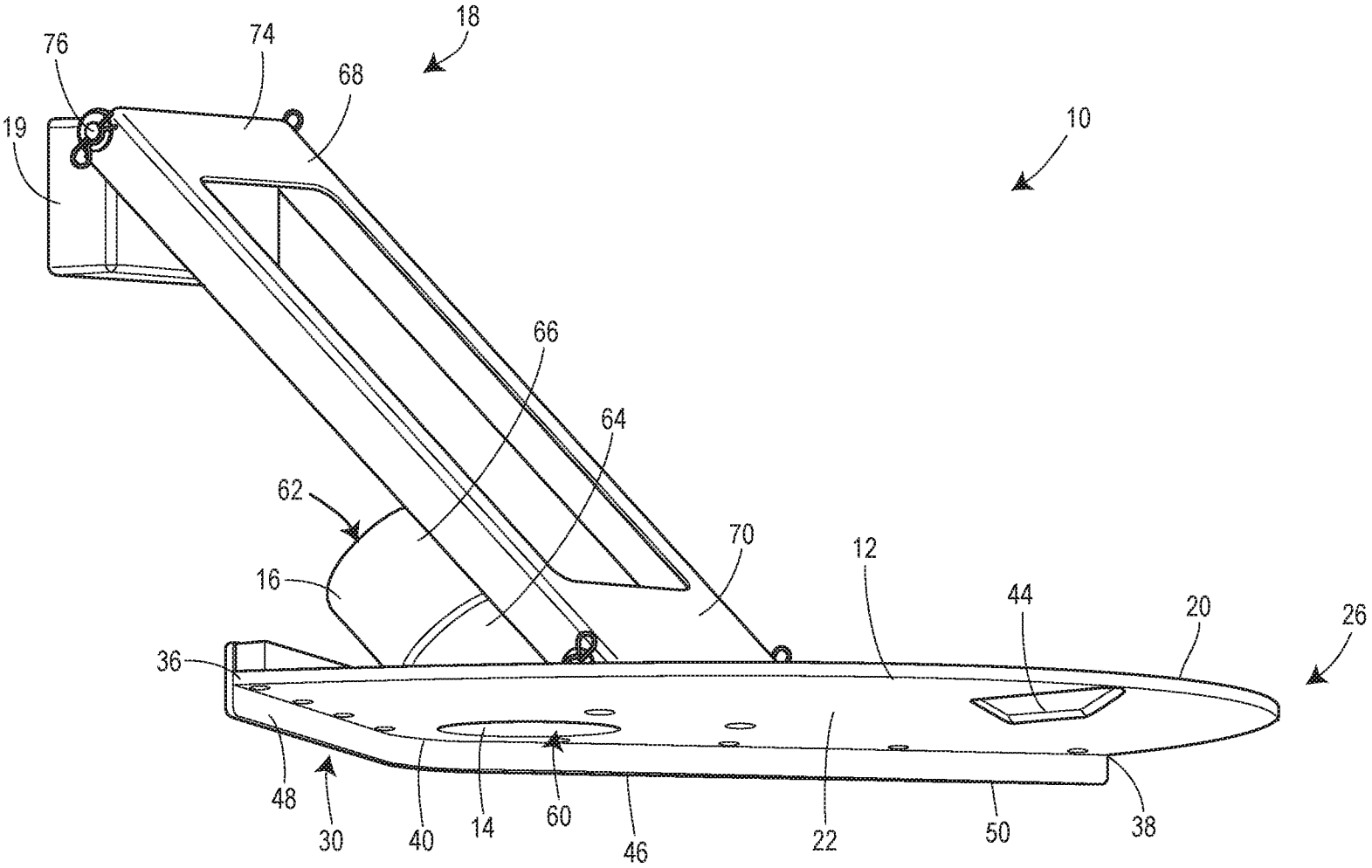
FIG. 5 is a different perspective view of the nozzle of FIG. 1.

The nozzle 10 is also configured for use with a push-cart vacuum cleaner or other mobile vacuum cleaning devices where a nozzle is attached to the vacuum cleaner and directed over a floor by movement of the whole vacuum cleaner or its associated cart. As best shown in FIGS. 1 and 5, the nozzle 10 includes a removable bracket assembly 18 that is configured to couple the nozzle 10 to a tank of a vacuum cleaner so that the nozzle 10 may be pushed along a cleaning surface S when an operator pushes the vacuum cleaner. The bracket assembly 18 includes a tank fitting 19 and a bracket 68 having a first end 70 coupled to the body 12 and a second end 74 coupled to the fitting 19. Specifically, the first end 70 of the bracket 68 is hingedly coupled to the first surface 20 of the body 12 by a hinge pin 72, permitting the body 12 of the nozzle 10 to rotate about an axis of the hinge pin 72. The rotatable feature of the body 12 relative to the bracket 68 about the axis of the hinge pin 72 permits an operator to easily access and clean the second surface 22 of the body 12 when the body 12 is rotated so that the second surface 22 faces upward (e.g., FIG. 15). At an opposing end 74, the bracket 68 is hingedly coupled to the vacuum tank fitting 19 by a second hinge pin 76. In FIG. 4, the bracket assembly 18 is oriented so that the bracket 68 is parallel to the axis A of the fitting 16 and extends from the first surface 20 of the body 12 to the tank fitting 19. In this orientation, the bracket 68 is disposed at an angle λ relatively to the body 12 of the nozzle 10. The bracket 68 and the first surface 20 of the body 12 form the angle λ, which is preferably in a range between approximately 90 degrees and approximately 180 degrees relative to the first surface 20 and/or horizontal surface S. The bracket 68 is oriented downward and away from the tank fitting 19 at an angle β relative to vertical V, which is preferably in a range between approximately 0 degrees and approximately 90 degrees relative to the vertical V.

The hinge pins 72 and 76 of the bracket assembly 18 may be adjustable so that the nozzle 10 is either flexibly coupled or rigidly coupled relative to the vacuum cleaner. For example, the hinge pin 72 may be tightened so that the bracket 68 is rigidly connected to the body 12 or the hinge pin 72 may be loosened so that the bracket 68 is flexibly connected to the body 12, permitting the nozzle 10 to self-adjust relative to the body 12 during use. Further, the hinge pin 76 may be tightened so that the bracket 68 is rigidly connected to the tank fitting 19 or the hinge pin 76 may be loosened so that the bracket 68 is flexibly connected to the tank fitting 19, permitting the nozzle 10 to self-adjust relative to the tank fitting 19 during use. In other words, the hinge pins 72 and 76 may be tightened to set (e.g., fix, secure) the bracket 68 at a desired angle λ relative to the body 12 and angle β relative to the tank fitting 19, respectively. When fully tightened, each hinge pin 72 and 76 can reduce instances of rotation or pivoting of the bracket 68 relative to the body 12 and the tank fitting 19, respectively. Alternatively, the hinge pins 72 and 76 may be loosened to a certain degree to provide the nozzle 10 with a certain degree of flexibility when the nozzle 10 is in use.

So configured, the orientation of the bracket 68 relative to the nozzle 10, and therefore the angle λ, is adjustable by fastening or tightening the hinge pin 72 in place when the desired angle λ is reached. Similarly, the orientation of the bracket 68 relative to the fitting 19, and therefore the angle β, is adjustable so that the nozzle 10 may work with vacuum cleaners of different shapes and sizes. For example, the hinge pin 76 may be fastened according to the location of the vacuum cleaner tank relative to the cleaning surface S. For a vacuum cleaner with a tank adjacent to the cleaning surface, the angle β may be set to approximately 45 degrees or more so that the fitting 19 lies flush with the tank. When the hinge pins 72 and 76 are fully tightened, the bracket assembly 18 maintains the angled orientation of the bracket 68 relative to both the vacuum cleaner tank and the horizontal cleaning surface S. This may be particularly useful for cleaning a flat surface. As shown in FIG. 1, the tank fitting 19 includes a curved mating surface 78 that is shaped to lie flush against an exterior surface of the vacuum cleaner tank. However, in other embodiments, the tank fitting 19 may be another shape or may be made of a deformable foam or gel to mold to the outer surface of the vacuum cleaner tank.

Figure 6:
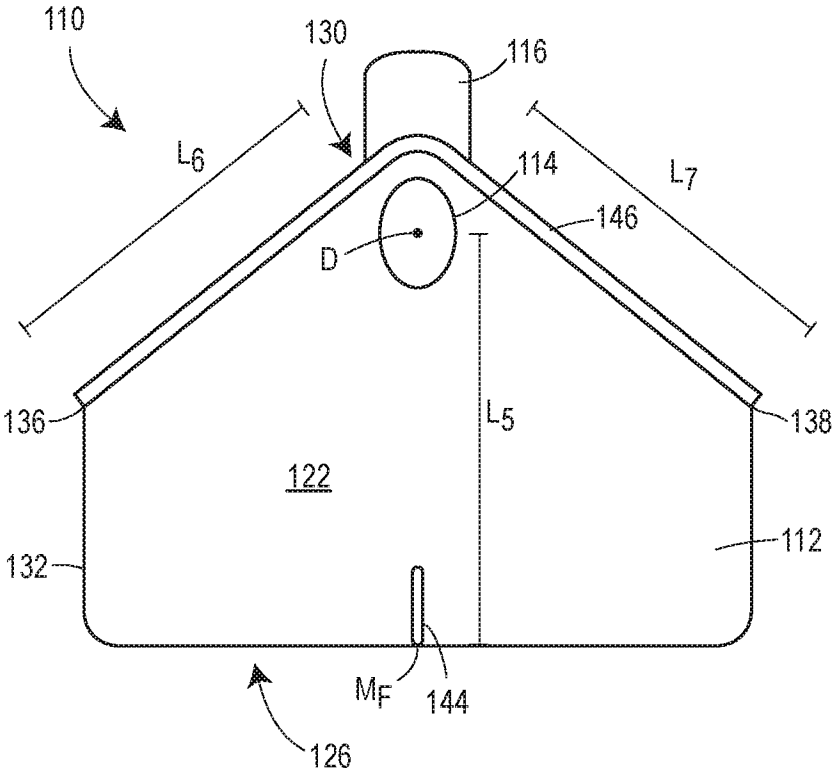
FIG. 6 is a bottom view of a second exemplary wide-area vacuum nozzle assembled in accordance with the teachings of the present disclosure.

Turning now to FIG. 6, a second exemplary wide-area vacuum nozzle 110 is constructed in accordance with the teachings of the present disclosure. The second exemplary wide-area vacuum nozzle 110 is substantially similar to the first exemplary nozzle 10 of FIGS. 1-5 described above. Thus, for ease of reference, and to the extent possible, the same or similar components of the second exemplary nozzle 110 will retain the same reference numbers as outlined above with respect to the first exemplary nozzle 10, although the reference numbers will be increased by 100. A description of many of these elements is abbreviated or even eliminated in the interest of brevity. However, unlike the first exemplary nozzle 10 of FIGS. 1-5, the second exemplary nozzle 110 includes a body 112 having a rectangular leading edge 126. In this example, the body 112 includes parallel sides or segments that together with the leading edge 126 define the outer periphery 132. As shown in FIG. 6, a distance between centerpoint D of an aperture 114 and a midpoint $M_F$ of the leading edge 126 has a length $L_5$, a distance between a first juncture 136 and the centerpoint D has a length $L_6$, and a distance between a second juncture 138 and centerpoint D has a length $L_7$. Length $L_5$ may be the same or equal to each of lengths $L_6$ and $L_7$. The air flow distribution at an outer periphery 132 of the rectangular leading edge 126 may facilitate cleaning corners, shelves, and crevices near walls.

Figure 7:
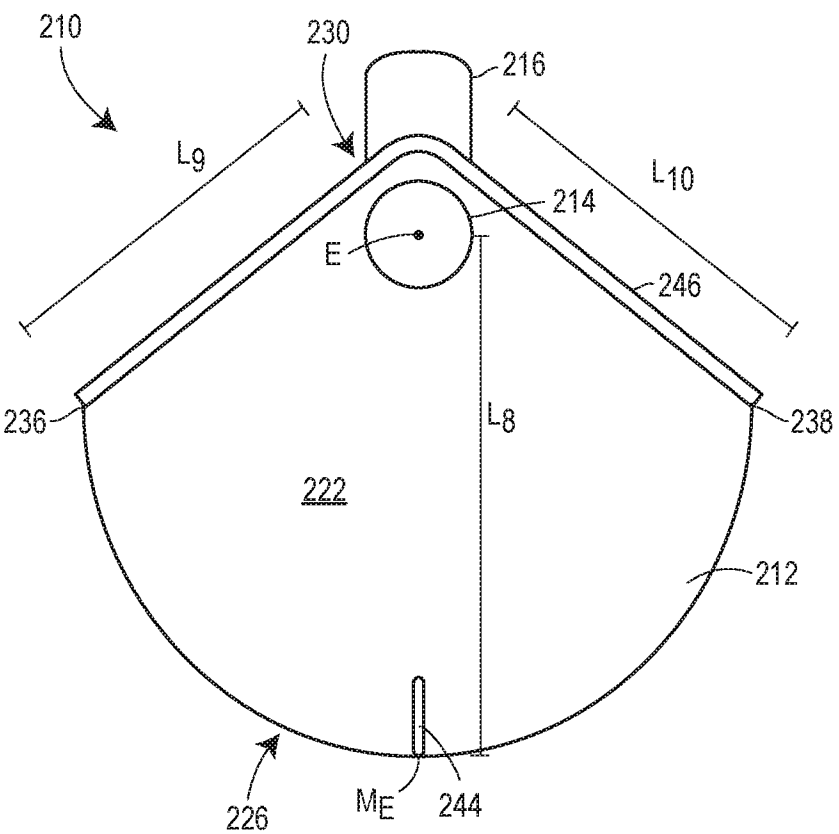
FIG. 7 is a bottom view of a third exemplary wide-area vacuum nozzle assembled in accordance with the teachings of the present disclosure

In FIG. 7, a third exemplary wide-area vacuum nozzle 210 is constructed in accordance with the teachings of the present disclosure. The third exemplary wide-area vacuum nozzle 210 is substantially similar to the first exemplary nozzle 10. Thus, for ease of reference, and to the extent possible, the same or similar components of the third exemplary nozzle 210 will retain the same reference numbers as outlined above with respect to the first exemplary nozzle 10, although the reference numbers will be increased by 200. A description of many of these elements is abbreviated or even eliminated in the interest of brevity. Unlike the nozzle 10 of FIGS. 1-5, the third exemplary nozzle 210 includes a body 212 with a leading edge 226 in the shape of an elliptical arc. As shown in FIG. 7, a distance between centerpoint E of an aperture 214 and a midpoint $M_E$ of the leading edge 226 has a length $L_8$, a distance between a first juncture 236 and the centerpoint E has a length $L_9$, and a distance between a second juncture 238 and centerpoint E has a length $L_{10}$. Length $L_8$ is greater than each of lengths $L_9$ and $L_{10}$. In this example, the aperture 214 is circular.

Turning now to FIGS. 8-11, a fourth exemplary wide-area vacuum nozzle 310 is constructed in accordance with the teachings of the present disclosure. The fourth exemplary wide-area vacuum nozzle 310 is substantially similar to the first exemplary nozzle 10. Thus, for ease of reference, and to the extent possible, the same or similar components of the fourth exemplary wide-area vacuum nozzle 310 will retain the same reference numbers as outlined above with respect to the first exemplary nozzle 10, although the reference numbers will be increased by 300. However, the fourth exemplary nozzle 310 differs from the first exemplary nozzle 10 in the manner discussed below.

In the fourth exemplary nozzle 310, a nozzle fitting 316 and a spacer 344 are integrally formed with a body 312 of the nozzle 10. Similar to the spacer 44 of the first exemplary nozzle 10, the spacer 344 of the nozzle 310 in FIGS. 8-11 extends away from a second surface 322 of the body 312 to keep a leading edge 326 of the nozzle 310 above the cleaning surface. The spacer 344 is molded into the body 312 such that a divot 341 is formed in a first surface 320. The spacer 344 is aligned with a midpoint $M_G$ of the leading edge 326, however, in other examples, the spacer 344 may be offset or perpendicular relative to the midpoint $M_G$. As shown in FIG. 9, the spacer 344 keeps the second surface 322 of the body 312 parallel to a target cleaning surface. The first surface 320 may be slightly contoured or angled relative to the second surface 322. In some examples, the second surface 322 may be contoured similarly as the first surface 320, or differently, such as providing grooves or corrugations, to affect the distribution of air flow.

Figure 8:
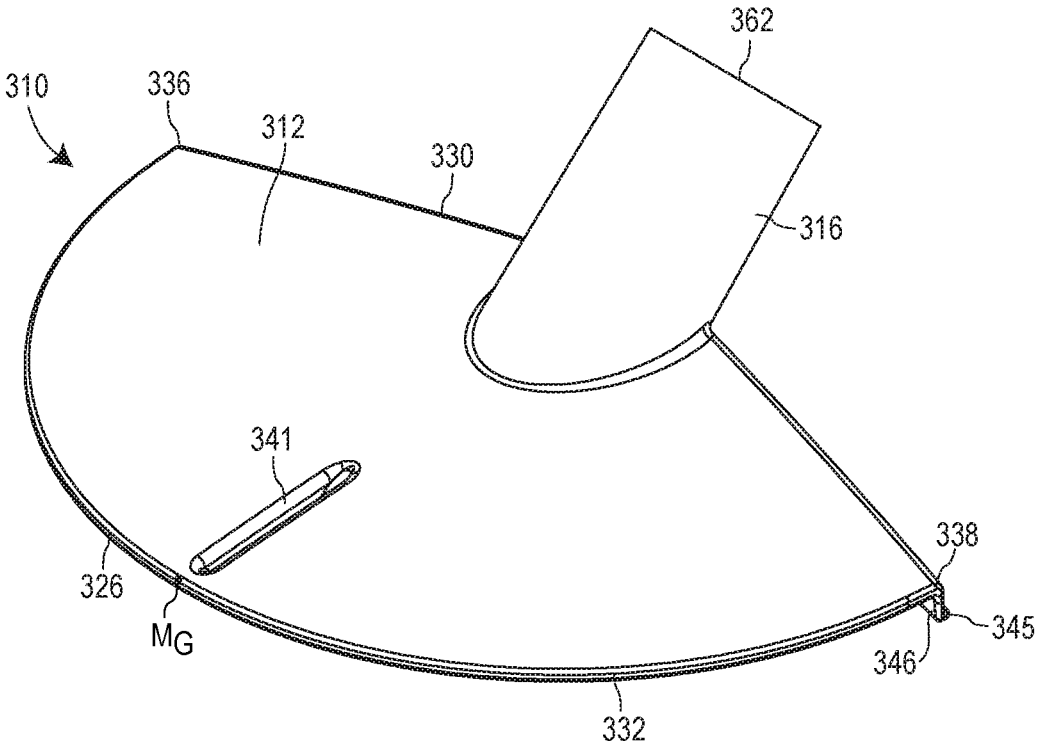
FIG. 8 is a perspective view of a fourth exemplary wide-area vacuum nozzle assembled in accordance with the teachings of the present disclosure.
Figure 9:
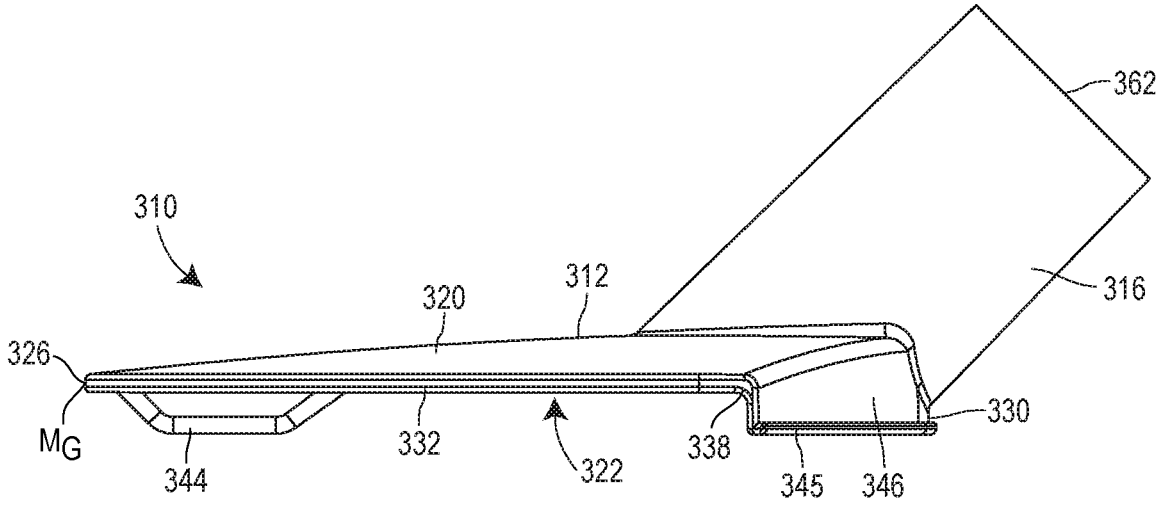
FIG. 9 is a side view of the nozzle of FIG. 8.
Figure 10:
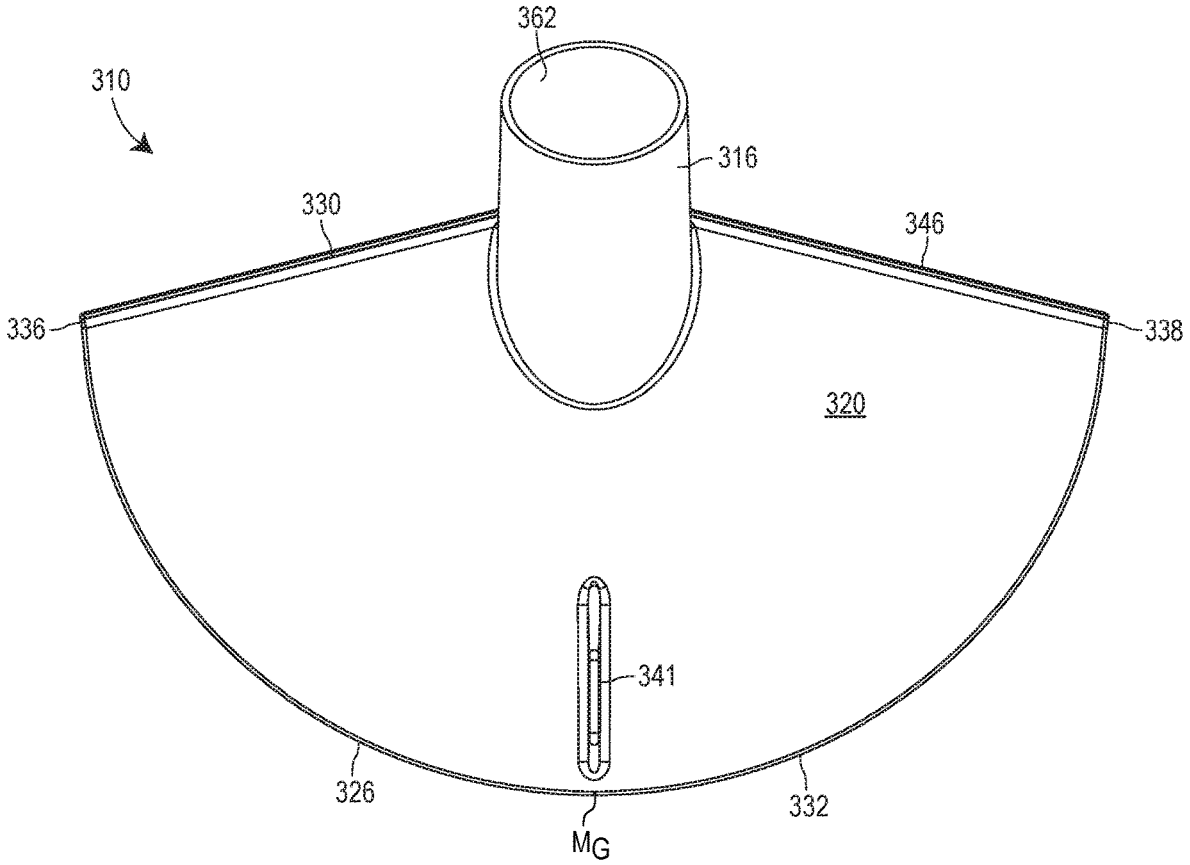
FIG. 10 is a top view of the nozzle of FIG. 8.
Figure 11:
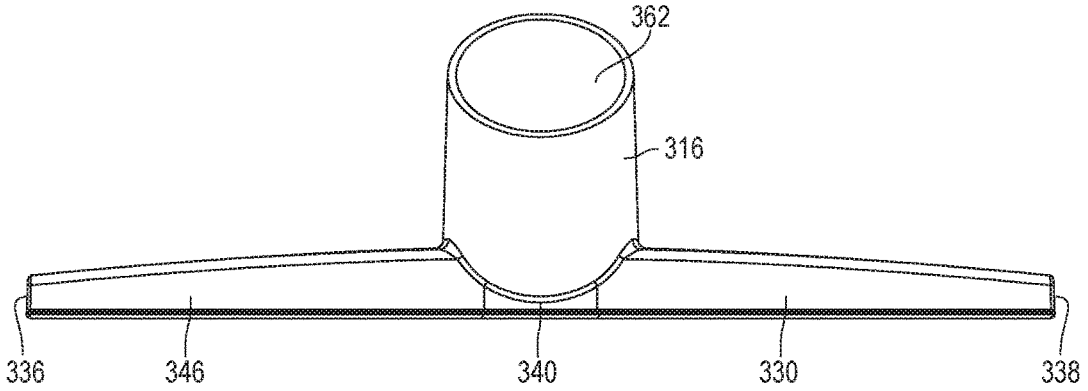
FIG. 11 is a back view of the nozzle of FIG. 8.

In FIGS. 8 and 9, a back wall 346 of the nozzle 310 includes a lip 345 (also referred herein as a flange), which extends away from the back wall 346 and parallel to the cleaning surface. The lip 345 may provide additional strength to the back wall 346 and may improve gliding of the nozzle 310 against the cleaning surface. Further, and as shown in FIGS. 9-11, the fitting nozzle 316 is integrally formed with the body 312 such that the fitting 316 extends at an angle away from the first surface 320 and from a trailing edge 330 of the body 312. By comparison to the fitting 16 of the first exemplary nozzle 10, the fitting 316 is partially formed in the back wall 346 of the trailing edge 330.

Figure 12:
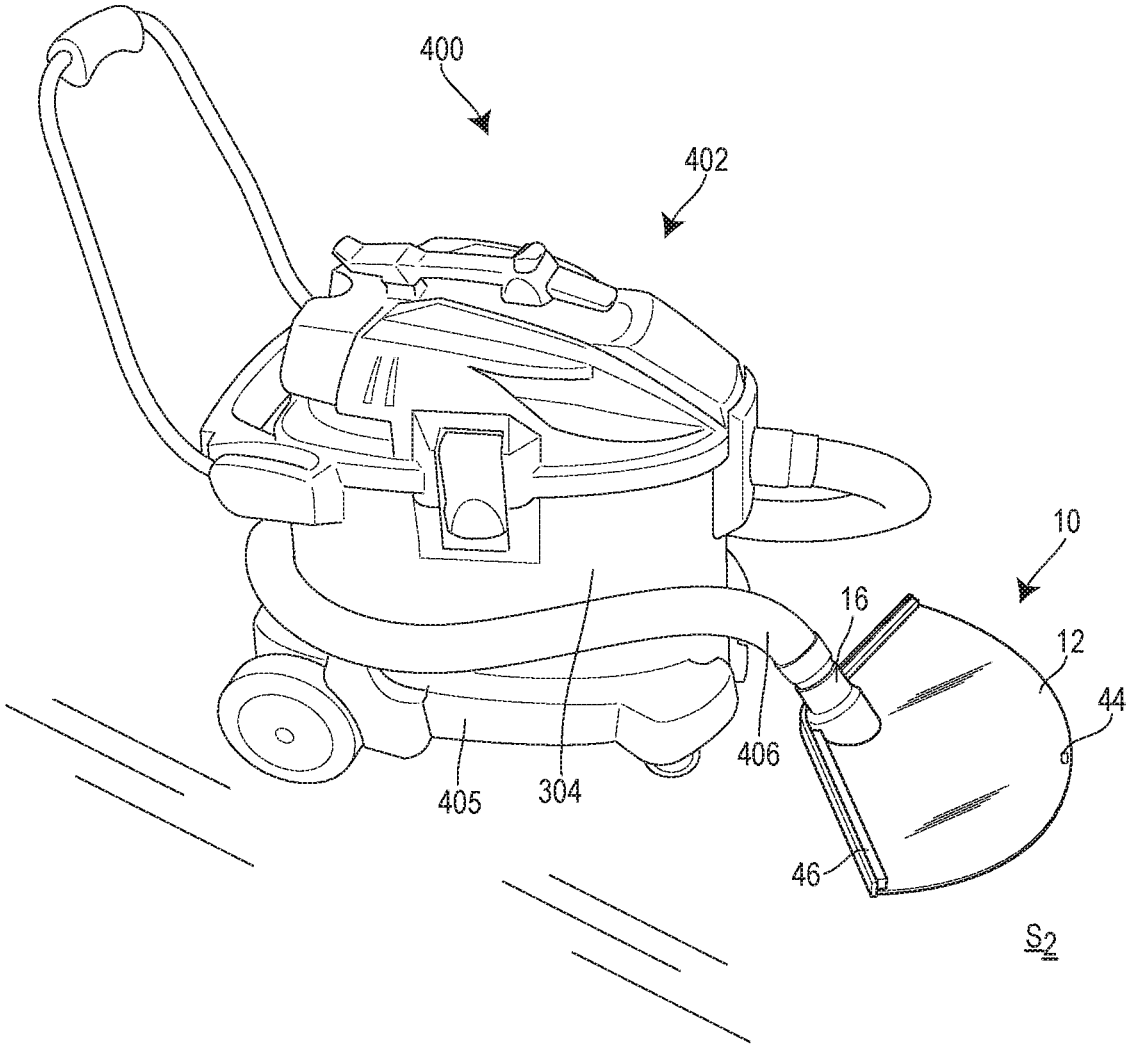
FIG. 12 is the wide-area vacuum nozzle of FIG. 1 attached to a hose of a vacuum cleaner in accordance with the teachings of the present disclosure.
Figure 13:
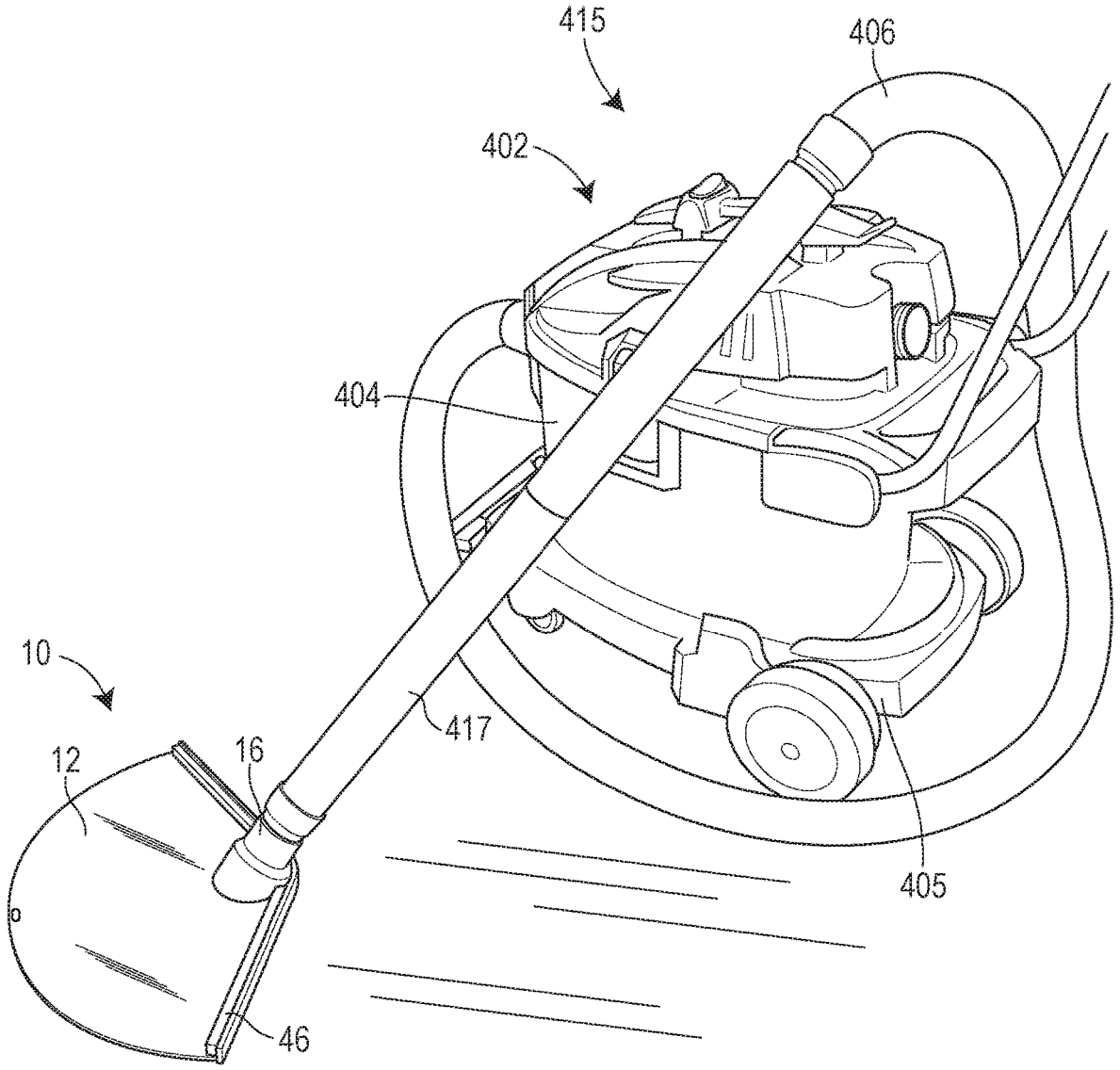
FIG. 13 is the wide-area vacuum nozzle of FIG. 1 attached to a wand of a vacuum cleaner in accordance with the teachings of the present disclosure.

FIGS. 12-16 illustrate exemplary arrangements of the first exemplary nozzle 10 connected to a vacuum source, which in this case, is a vacuum tank 404 of a vacuum cleaner 402 disposed on a wheeled cart 405. Second, third, and fourth exemplary nozzles 110, 210, and 310 are also configured to couple to the vacuum source 402. In other examples, the vacuum source may be any suitable vacuum tank. In FIGS. 12 and 13, the nozzle 10 is coupled to the vacuum cleaner 402 without the bracket assembly 18. However, the bracket assembly 18 may remain attached to the body 12 of the nozzle 10 even when the bracket assembly 18 is not in use.

Turning first to FIG. 12, a first exemplary arrangement 400 includes the vacuum cleaner 402 coupled to the nozzle 10 by a vacuum hose 406, where the body 12 of the nozzle 10 floats or hovers over a horizontal cleaning surface $S_2$. The hose 406 fluidly connects the fitting 16 of the nozzle 10 to the vacuum tank 404 of the vacuum cleaner, providing a fluid-tight seal at the fitting 16. A second exemplary arrangement 415 in FIG. 13 includes the vacuum cleaner 402 operatively coupled to the nozzle 10 by a wand 417. In this arrangement 415, the wand 417 fluidly connects the fitting 16 of the nozzle to the hose 406 of the vacuum cleaner 402. The wand 417 may be a standard vacuum accessory configured to fluidly connect the fitting 16 and the hose 406.

Figure 14:
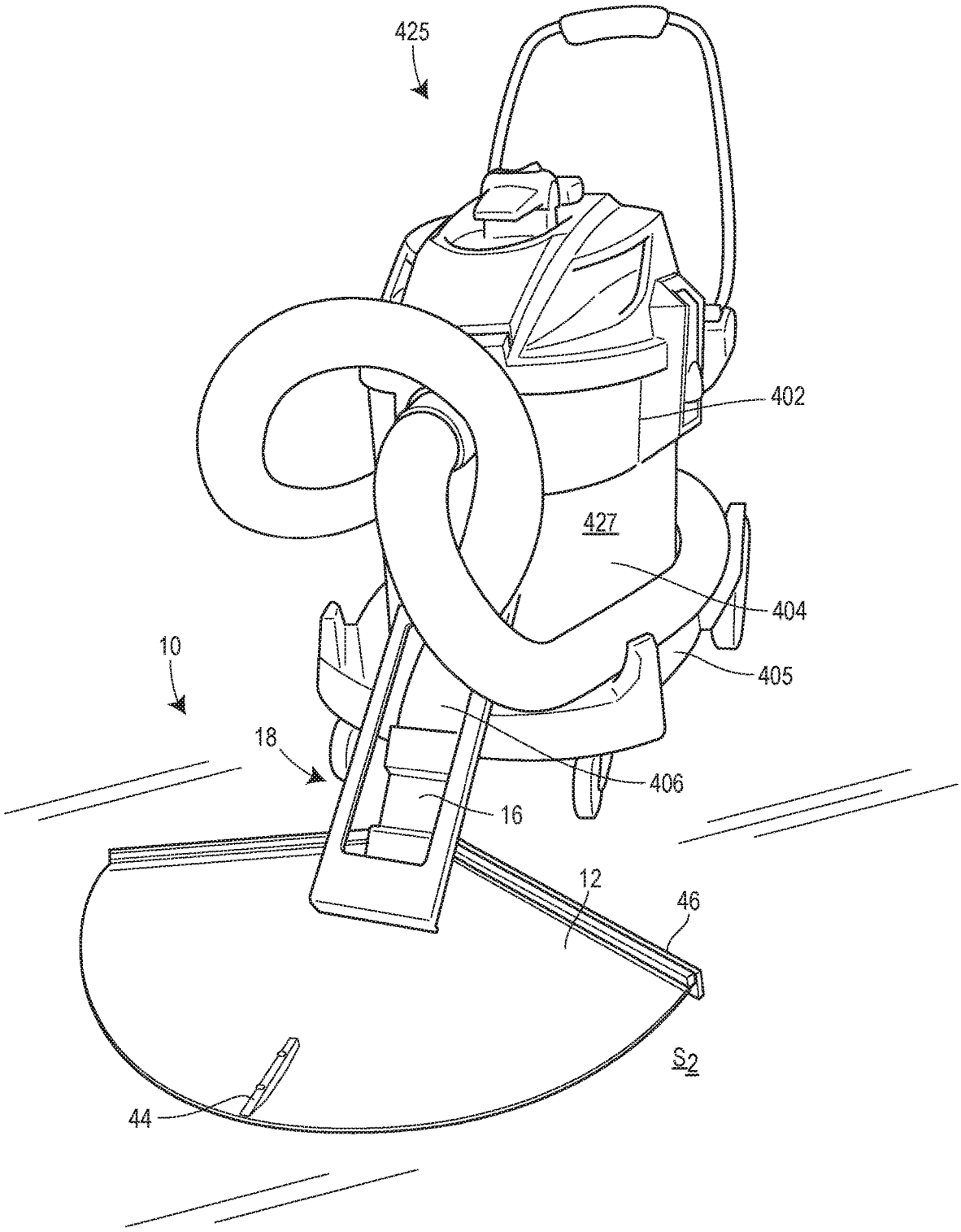
FIG. 14 is the wide-area vacuum nozzle and bracket assembly of FIG. 1 coupled to a vacuum cleaner in accordance with the teachings of the present disclosure.
Figure 15:
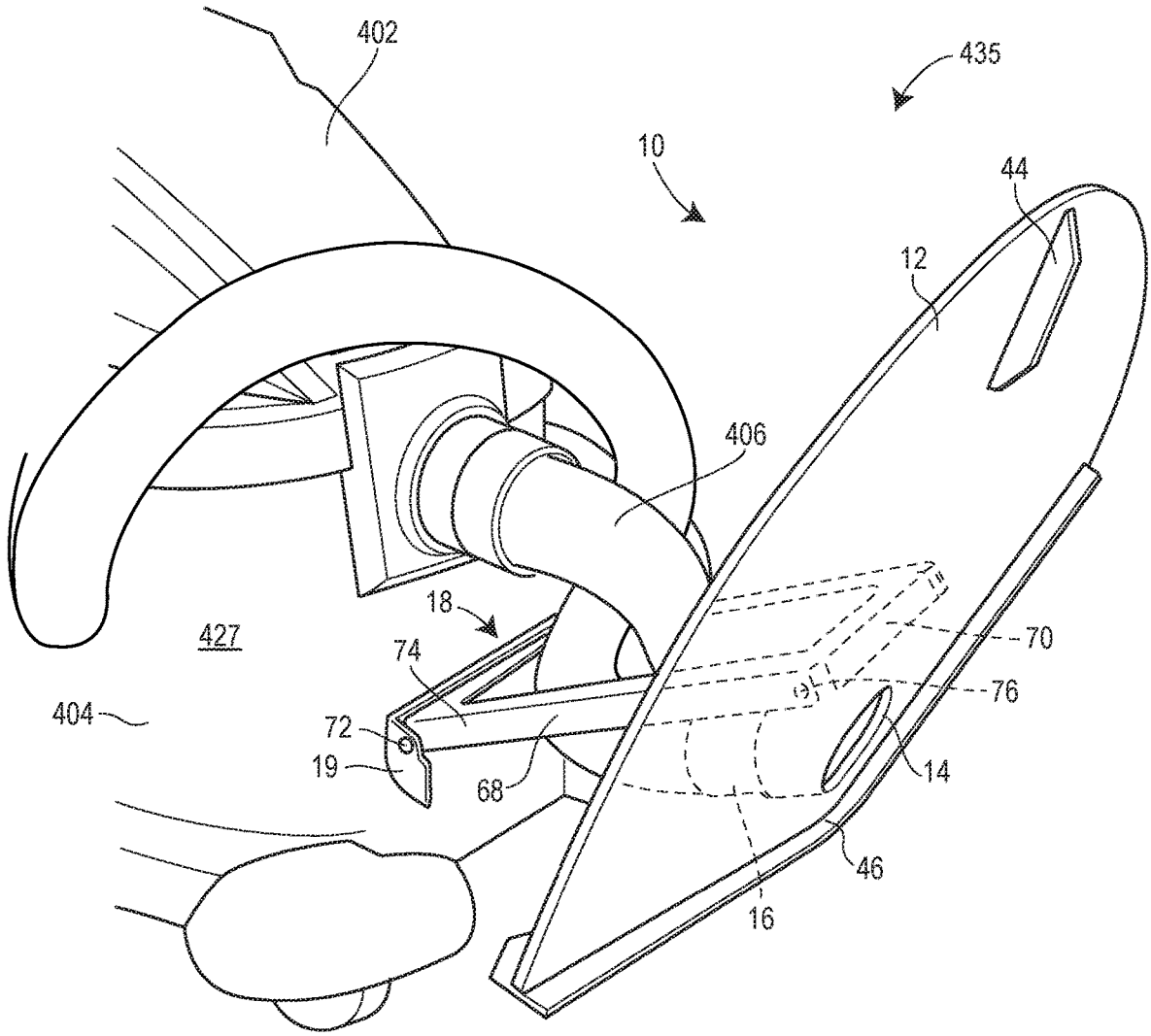
FIG. 15 is a different view of the bracket assembly and nozzle of FIG. 10 coupled to the vacuum cleaner.
Figure 16:
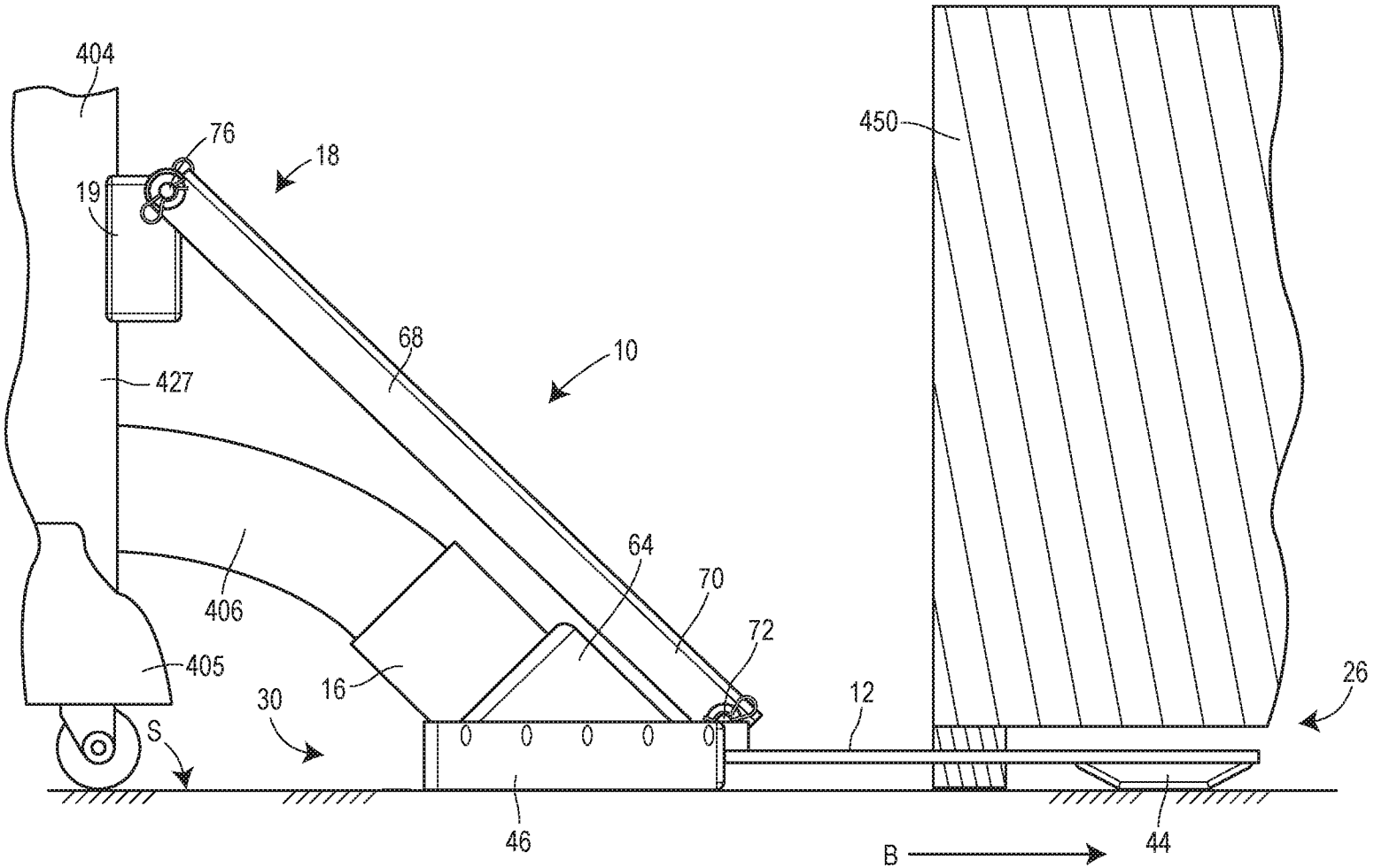
FIG. 16 is a side view of the wide-area vacuum nozzle of FIG. 1 partially disposed underneath furniture in accordance with the teachings of the present disclosure.

FIGS. 14-16 illustrate the first exemplary nozzle 10 operatively coupled to the vacuum cleaner 402 with the bracket assembly 18 attached between the nozzle 10 and the vacuum cleaner 402. The bracket 68 of the bracket assembly 18 is hingedly attached to the body 12 of the nozzle 10 at the first end 70 of bracket 68, and is connected to a tank fitting 19 at the second end 74. Better shown in FIG. 15, the tank fitting 19 of the bracket assembly 18 abuts against an exterior surface 427 of the vacuum tank 404, and the hose 406 of the vacuum cleaner is connected to the fitting 16 of the nozzle. The tank fitting 19 may be attached to the tank 404 or may be formed integrally with the wall of the tank 404. In FIG. 15, the nozzle 10 is shown in a lifted position where the body 12 of the nozzle 10 is angled away from the cleaning surface $S_2$. To lift the nozzle 10, the body 12 is rotated about the hinge pin 72 relative to the bracket 68, and the bracket 68 is rotated about the hinge pin 76 relative to the tank fitting 19.

FIG. 16 illustrates the nozzle 10 coupled to the vacuum tank 404 and partially disposed beneath a piece of furniture 500. In this example, the nozzle 10 may be pushed forward in a direction B to position the leading edge 26 of the body 12 within the narrow space formed between the cleaning surface $S_2$ and the furniture 400. Both the spacer 44 and the back wall 46 separate the body 12 of the nozzle 10 from directly contacting the cleaning surface $S_2$ and permit the body 12 to hover over the cleaning surface $S_2$ when pushed. In this example, an operator may push the vacuum cleaner 402 forward so that the vacuum tank 404 connected to the bracket assembly 18 directs the nozzle 10 in the forward direction B. The fitting 19 may rest against the exterior surface 427 of the tank 404 with or without an adhesive or other fastener securing the fitting 19 to the tank 404. For example, the fitting 19 may have a textured surface to frictionally engage the outer surface 427 of the tank 404 to limit the nozzle 10 from sliding away from the tank 404. Other suitable devices or mechanisms may be used to removably fasten the bracket assembly 18 to the tank 404. In the illustrated examples, the bracket assembly 18 attaches the tank 404 of the vacuum cleaner 402 to the nozzle 10. In other examples, however, the bracket assembly 18 may be configured to attach the wheeled cart 405 or some other part or structure of the vacuum cleaner 402 to the nozzle 10.

In FIGS. 17-20, a vacuum nozzle and bracket unit 600 is constructed in accordance with the teachings of the present disclosure. The unit 600 includes a fifth exemplary wide-area vacuum nozzle 610, a second exemplary bracket assembly 618, an adapter plate 621, and a connector hose 606. The fifth exemplary wide-area vacuum nozzle 610 is substantially similar to the first exemplary nozzle 10, and the second exemplary bracket assembly 618 is substantially similar to the first exemplary bracket assembly 18 discussed above. Thus, for ease of reference, and to the extent possible, the same or similar components of the fifth exemplary nozzle 610 and second exemplary bracket assembly 618 will retain the same reference numbers as outlined above with respect to the first exemplary nozzle 10 and the first exemplary bracket assembly 18, although the reference numbers will be increased by 600 respectively. However, the fifth exemplary nozzle 610 and second exemplary bracket assembly 618 differ in the manner discussed below.

Figure 17:
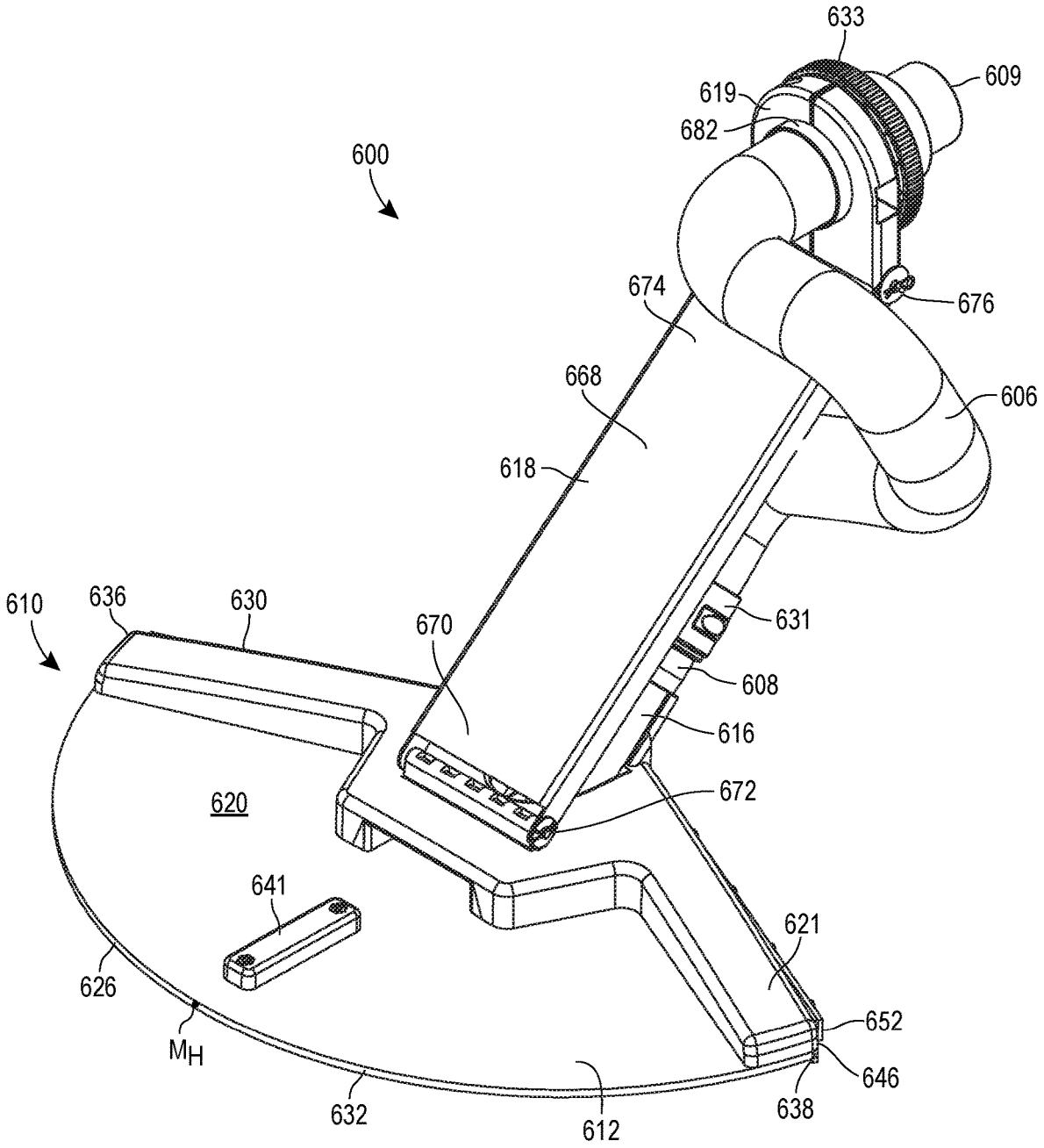
FIG. 17 is a perspective view of a fifth exemplary wide-area vacuum nozzle and a second exemplary bracket assembly for use with a vacuum cleaner assembled in accordance with the teachings of the present disclosure.
Figure 18:
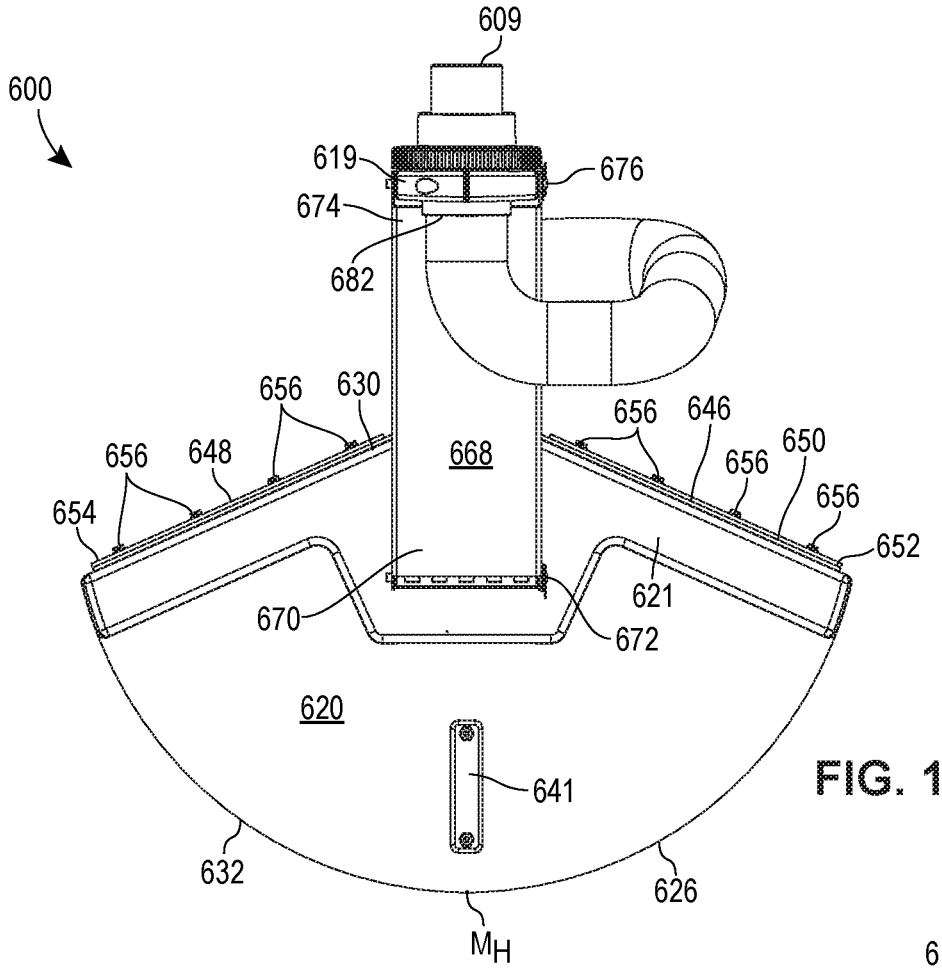
FIG. 18 is a top view of the wide-area vacuum nozzle of FIG. 17.

In FIG. 17, the vacuum nozzle and bracket unit 600 is assembled to facilitate coupling the nozzle 610 and bracket assembly 618 to a vacuum source at an intake port of the vacuum source. By comparison to the arrangement 435 of FIGS. 14-16, the bracket assembly 618 in FIG. 17 does not rest against the vacuum tank. The unit 600 includes a hose connector 606 secured to both the nozzle 610 and to the bracket assembly 618. In particular, the hose connector 606 includes a first end 608 and a second end 609, in which the first end 608 is sealably coupled to an aperture (not shown) in the nozzle body 612 and the second end 609 of the hose connector 606 is disposed through a bracket fitting 619 of the bracket assembly 618. The second end 609 of the hose connector 606 may be adapted to fluidly couple the aperture of the nozzle 610 to the intake port of a vacuum cleaner. As shown in FIG. 18, the second end 609 of the hose connector 606 is aligned with a bracket 668 and a midpoint $M_H$ of a leading edge 626 of the nozzle 610. In the illustrated example, the bracket 668 has an adjustable length so that a user may adjust the bracket assembly 618 to fit a number of different heights of vacuum cleaner intake ports. However, in other examples, the bracket 668 may be replaced with a bracket 668 of a different length to fit the bracket assembly 618 with a different vacuum cleaner.

Figure 20:
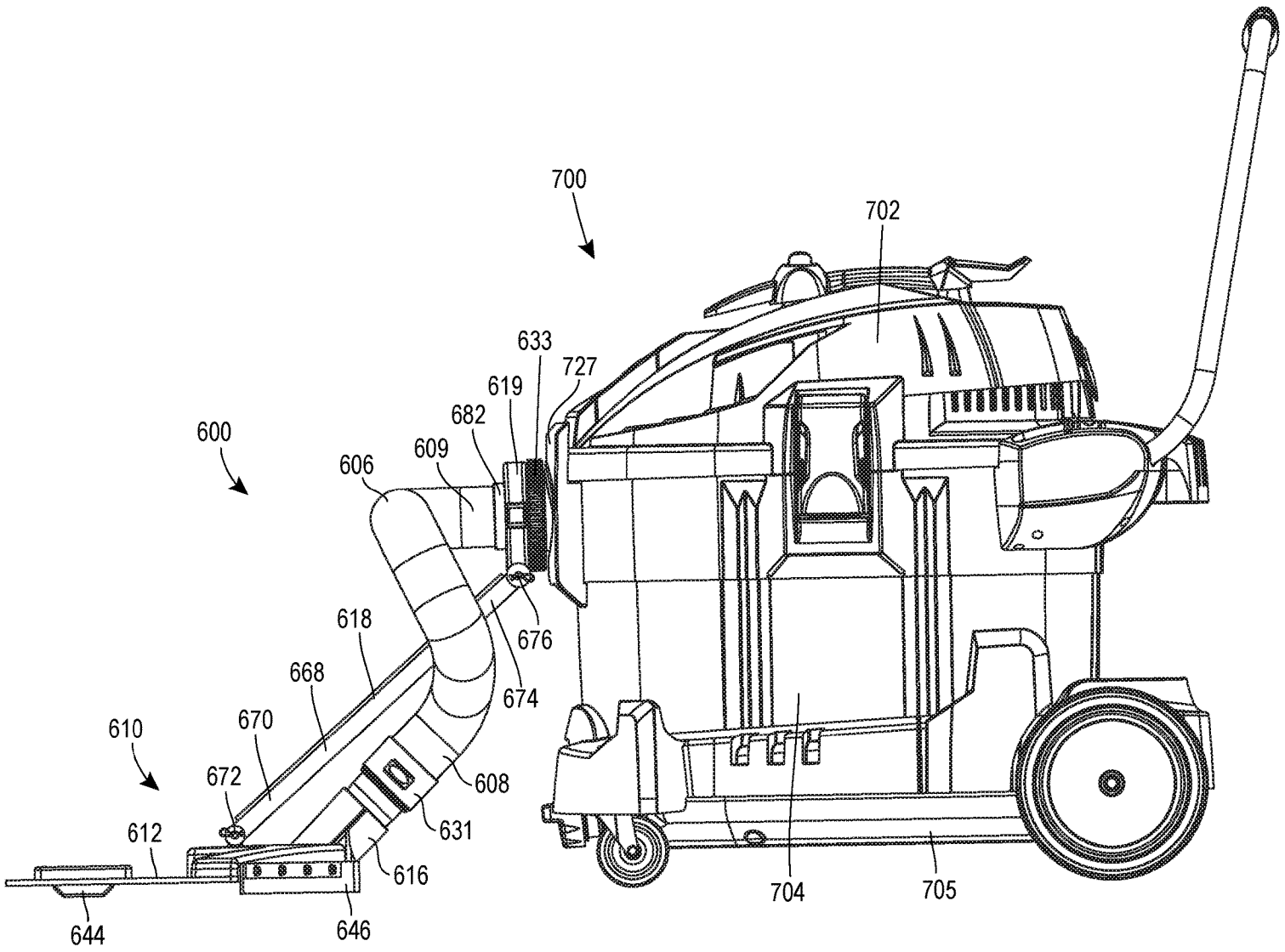
FIG. 20 is a perspective view of the wide-area vacuum nozzle and bracket assembly of FIG. 17 coupled to a vacuum cleaner in accordance with the teachings of the present disclosure.

The bracket fitting 619 of the bracket assembly 618 is hingedly coupled to a second end 674 of the bracket 668 so that the bracket 668 is free to move relative to a cleaning surface. By comparison to the fitting 19 of the first exemplary bracket assembly 18, the second exemplary fitting 619 does not lean against an outer surface of a vacuum cleaner, but instead is configured to help align the second end 609 of the hose connector 606 with the intake port of the vacuum cleaner. The second exemplary bracket fitting 619 couples the bracket 668 to a vacuum cleaner and aligns the hose connector 606 with the intake port of a vacuum cleaner 702, as shown in FIG. 20. The fitting 619 has an aperture 682 that receives the second end 609 of the hose connector 606 and holds the second end 609 in an orientation (e.g., parallel relative to a cleaning surface) to facilitate alignment of the hose connector 606 with the intake port of the vacuum cleaner. In the illustrated example, the hose connector 606 extends through the aperture 682 of the fitting 619. However in another example, the second end 609 of the hose connector 606 may be a separate connector piece that extends through the aperture 682 between the hose connector 606 and the intake of the vacuum cleaner.

The hose connector 606, bracket assembly 618, and nozzle 610 may be separable to facilitate disassembly and storage of each of the parts of the unit 600. The hose connector 606 may be locked to the nozzle 610 by a first fastening device 631 at the first end 608, and locked to the fitting 619 by a second fastening device 633 at the second end 609. The first fastening device is 631 is a snap-lock that snaps a nozzle fitting 616 of the nozzle 610 to the first end 608 of the hose connector 606 when the hose connector 606 is inserted into the fitting nozzle 616. The second fastening device 633 is disposed between the fitting 619 and the second end 609 of the hose connector 606 to removably couple the second end 609 of the hose connector 606 to the intake port of the vacuum cleaner. The second fastening device 633 may be a rotatable lock that rotates to remove or secure the second end 609 of the hose connector 606 to the fitting 619. The fitting 619 may be tightened and locked around the second end 609 of the hose connector 606 via the second fastening device 633, which may adjust the size of the aperture 682 to receive different hose sizes. In other examples, the first and second fastening devices 631, 633 may lock to the hose connector 606 and fitting 619, respectively, by other fastening mechanisms.

Figure 19:
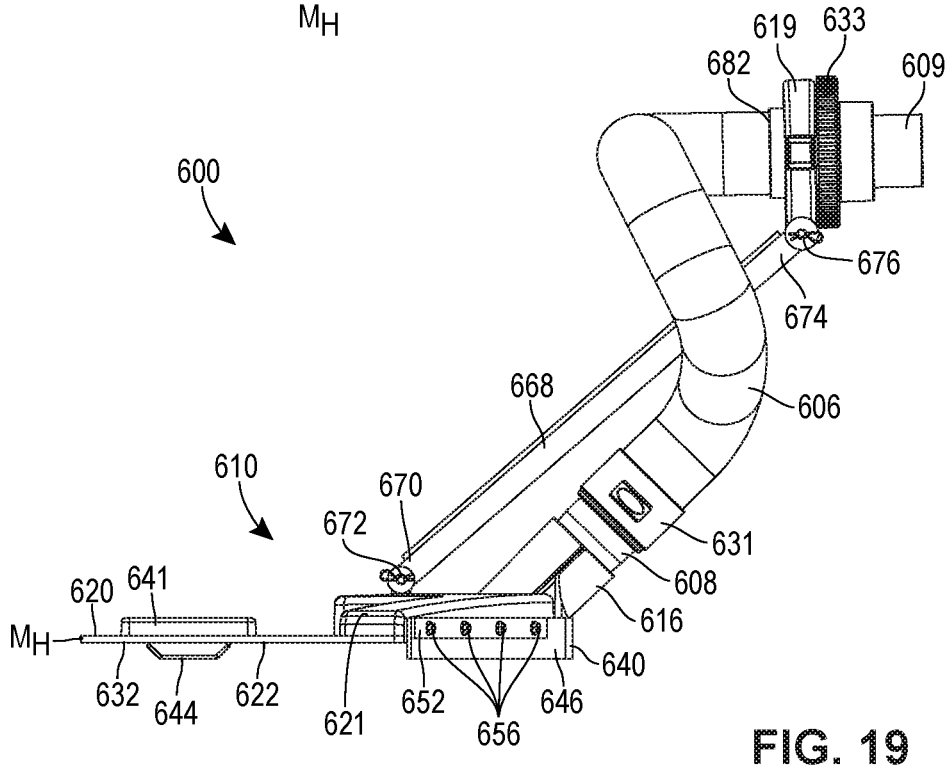
FIG. 19 is a side view of the wide-area vacuum nozzle of FIG. 17.

As shown in FIGS. 17 and 18, the fifth exemplary nozzle 610 also differs from the first exemplary nozzle 10 by including the adapter plate 621. The adapter plate 621 is attached to a first surface 620 of the body 612 and extends along a trailing edge 630 of the body 612 between a first juncture 636 and a second juncture 638 of a back wall 646. A first end 670 of the bracket 668 is hingedly coupled to the adapter plate 621. The adapter plate 621 is shaped to fit around the fitting 616. In FIG. 19, the back wall 646 is secured to the adapter plate 621 by a plurality of fasteners 656.

FIG. 20 illustrates an exemplary arrangement 700 of the nozzle and bracket unit 600 connected to a vacuum source, which in this case, is a vacuum tank 704 of a vacuum cleaner 702 disposed on a wheeled cart 705. The nozzle 610 is operatively coupled to the vacuum cleaner 702 with the bracket assembly 618 and fitting 619. The bracket 668 of the bracket assembly 618 is hingedly attached to the body 612 of the nozzle 610 at the first end 670 of the bracket 668, and is connected to the fitting 619 at the second end 674. The fitting 619 is spaced away from the outer surface 727 of the tank 702 and aligns the second end 609 of the hose connector 606 of with the intake port of the vacuum cleaner. As shown in the side view of FIG. 20, the bracket assembly 618 does not lean against the outer surface 727 of the vacuum cleaner 702. Instead, and as described above, the fitting 619 is disposed between the bracket 668 and the vacuum cleaner 702 and couples the unit 600 to the vacuum cleaner 702 at one connection point.

Each of the wide-area vacuum nozzles 10, 110, 210, 310, and 610 of the present disclosure provides a cleaning tool specifically suited to reach difficult cleaning areas and to reduce cleaning time. The nozzles 10, 110 210, 310, and 610 may effectively harness the suction force of a vacuum cleaner to clean a wide target surface area, extending air suction capabilities across a wide inlet peripheral edge. In particular, the nozzles 10, 110 210, 310, and 610 maximize the debris gathered on flat surfaces and beneath furniture, cabinets, and other areas adjacent walls or other vertical surfaces. The generally flat and thin body 12, 112, 212, 312, and 612 of each nozzle 10, 110, 210, 310, and 610 allows the nozzle 10, 110, 210, 310, and 610 to fit within narrow gaps. The rounded leading edge 26, 126, 226, 326, and 626 of each nozzle 10, 110, 210, 310, and 610 extends the suction force and/or air distribution beyond an area immediately adjacent the aperture and gathers debris pick-up close to walls and other vertical surfaces. The shape of the flat body 12, 112, 212, 312, and 612 of each nozzle 10, 110, 210, 310, and 610 may evenly distribute air suction across the outer periphery 32, 132, 232, 332, and 632 of the body 12, 112, 212, 312, and 612, and may even enhance suction at the first juncture 36, 136, 236, 336, and 636 and/or second juncture 38, 138, 238, 338, and 638 unlike most other nozzle designs where suction at the edges is often weak. The transparent body 12, 112, 212, 312, and 612 of each nozzle 10, 110, 210, 310, and 610 also permits an operator to efficiently clean a target surface area by revealing whether debris is successfully drawn into the aperture of the nozzle 10, 110, 210, 310, and 610. If the debris is too heavy to be picked up near the outer periphery 32, 132, and 232, then the operator may guide the nozzle 10, 110, 210, 310, and 610 so that the aperture is positioned directly above the heavy object.

Additionally, the nozzles 10, 110, 210, 310, and 610 of the present disclosure are adaptable for use with different vacuum cleaners and vacuum cleaner functions. For example, the bracket assemblies 18 and 618 permit an operator to easily maneuver the nozzle 10, 110, 210, 310, and 610 when the nozzle 10, 110, 210, 310, and 610 is operatively coupled to a vacuum tank supported by a wheeled vacuum cart. For a different cleaning job, the fitting 16, 116, 216, 316, and 616 of each nozzle 10, 110, 210, 310, and 610 may operatively couple to an adapter or a hose so that the nozzle 10, 110, 210, 310, and 610 may be manually operated for greater control. The hinge pins 72, 672 and 76, 676 of the bracket assemblies 18 and 618 also provide greater adaptability to the nozzle 10, 110, 210, 310, and 610 by permitting an operator to adjust the nozzle 10, 110, 210, 310, and 610 according to a particular type and size vacuum cleaner. Additionally, the hinge pins 72, 672 and 76, 676 provide the nozzle 10, 110, 210, 310, and 610 with a range of flexibility, permitting the nozzle 10, 110, 210, 310, and 610 to self-adjust to varying floor conditions. As described above, the wide-area vacuum nozzles 10, 110, 210, 310, and 610 are adaptable for use with a vacuum source. In other examples, however, the wide-area vacuum nozzles 10, 110, 210, 310, and 610 may be used as a blowing accessory and may be attached to a blower port of a vacuum to distribute air flow out through the aperture and around the leading edge of the body.

The figures and description provided herein depict and describe preferred embodiments of a wide-area vacuum nozzle for purposes of illustration only. One skilled in the art will readily recognize from the foregoing discussion that alternative embodiments of the components illustrated herein may be employed without departing from the principles described herein. Thus, upon reading this disclosure, those of skill in the art will appreciate still additional alternative structural and functional designs for vacuum nozzles. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the methods and components disclosed herein without departing from the spirit and scope defined in the appended claims.

What is claimed:

1. A wide-area vacuum nozzle, the nozzle comprising:

a body having a first surface, a second surface, a leading edge, and a trailing edge, the leading edge and trailing edge at least partially defining an outer periphery of the body, the body including a first juncture and a second juncture disposed between the leading edge and the trailing edge;

an aperture formed through the first surface and second surface of the body and disposed between the leading edge and the trailing edge;

a fitting connected to the aperture, the fitting adapted for connection to a vacuum source; and a back wall operatively coupled to the trailing edge of the body and oriented perpendicularly relative to the body, the back wall extending beyond a width of the leading edge of the body;

wherein the leading edge forms an arc extending between the first juncture and the second juncture.

2. The wide-area vacuum nozzle of claim 1, wherein the outer periphery of the body is a fan shape and the aperture is positioned adjacent a bend of the trailing edge.

3. The wide-area vacuum nozzle of claim 2, wherein the fitting is operatively coupled to the body between the first juncture and the second juncture and adjacent to the bend of the trailing edge.

4. The wide-area vacuum nozzle of claim 1, wherein the body is transparent.

5. The wide-area vacuum nozzle of claim 1, wherein the back wall is an ultra-high molecular weight polyethylene.

6. The wide-area vacuum nozzle of claim 1, wherein the back wall extends in a perpendicular direction beyond the second surface of the body to contact a cleaning surface.

7. The wide-area vacuum nozzle of claim 1, wherein the back wall extends a distance D beyond the second surface of the body, wherein the distance D is in a range of approximately 0.25 inches to approximately 1 inch.

8. The wide-area vacuum nozzle of claim 1, wherein the back wall is integrally formed with the trailing edge.

9. The wide-area vacuum nozzle of claim 1, wherein the back wall includes an outwardly extending flange, the flange angled relative to the back wall.

10. The wide-area vacuum nozzle of claim 1, wherein a midpoint of the arc of the leading edge is a first distance from a centerpoint of the aperture, the first juncture is a second distance from the centerpoint of the aperture, and the second juncture is a third distance from the centerpoint of the aperture, and wherein the second distance is approximately the equal to the third distance.

11. The wide-area vacuum nozzle of claim 10, wherein the first distance is greater than or equal to each of the second distance and the third distance.

12. The wide-area vacuum nozzle of claim 10, wherein the distance between the first juncture and the second juncture is in a range of approximately 10 inches to approximately 30 inches.

13. The wide-area vacuum nozzle of claim 1, wherein the fitting is sealably coupled to the first surface of the body and surrounds the aperture formed in the first surface.

14. The wide-area vacuum nozzle of claim 1, wherein the fitting is centered about a fitting axis extending from the first surface of the body, the fitting disposed at an angle relative to the first surface of the body.

15. The wide-area vacuum nozzle of claim 1, wherein the body is a plate and the first surface and second surface of the plate are parallel.

16. The wide-area vacuum nozzle of claim 1, further comprising a bracket assembly operatively coupled to the body of the nozzle, the bracket assembly including a bracket hingedly coupled to the body.

17. The wide-area vacuum nozzle of claim 1, wherein the leading edge and the trailing edge of the body meet at the first juncture and the second juncture.

18. The wide-area vacuum nozzle of claim 1, wherein a periphery of the leading edge is a circular arc.

19. The wide-area vacuum nozzle of claim 1, wherein a periphery of the leading edge is an elliptical arc.

20. The wide-area vacuum nozzle of claim 1, further comprising a spacer extending away from the second surface of the body, the spacer adapted to separate the second surface of the body from a cleaning surface.

21. A wide-area vacuum nozzle, the nozzle comprising:

a body having a first surface, a second surface, a leading edge, and a trailing edge, the leading edge and trailing edge at least partially defining an outer periphery of the body, the outer periphery including a first juncture and a second juncture disposed between the leading edge and the trailing edge;

an aperture formed through the first surface and second surface of the body, the aperture disposed between the leading edge and the trailing edge; and a back wall of durable material operatively coupled to the trailing edge and perpendicularly oriented relative to the body, the back wall extending beyond the second surface of the body at a distance greater than a width of the leading edge of the body to contact a cleaning surface.

22. The wide-area vacuum nozzle of claim 21, wherein the back wall is integrally formed with the trailing edge.

23. The wide-area vacuum nozzle of claim 21, wherein the back wall includes an outwardly extending flange.

24. The wide-area vacuum nozzle of claim 21, wherein the distance is in a range of approximately 0.25 inches to approximately 1 inch.

25. The wide-area vacuum nozzle of claim 21, wherein a material of the back wall is an ultra-high molecular weight polyethylene.

26. The wide-area vacuum nozzle of claim 21, wherein the leading edge defines an arc extending between the first juncture and the second juncture, and the trailing edge defines a bend between the first juncture and the second juncture.

27. The wide-area vacuum nozzle of claim 26, wherein the outer periphery of the body is a fan shape and the aperture is positioned adjacent the bend of the trailing edge.

28. The wide-area vacuum nozzle of claim 21, wherein the body is transparent.

29. The wide-area vacuum nozzle of claim 21, a periphery of the leading edge is a circular arc.

30. The wide-area vacuum nozzle of claim 21, wherein a periphery of the leading edge is an elliptical arc.

31. The wide-area vacuum nozzle of claim 21, further comprising a fitting sealably coupled to the first surface of the body and surrounding the aperture formed in the first surface.

32. The wide-area vacuum nozzle of claim 31, wherein the fitting is centered about a fitting axis extending from the first surface of the body, the fitting disposed at an angle relative to the first surface of the body.

33. The wide-area vacuum nozzle of claim 32, wherein the angle of the fitting relative to the first surface of the body is in a range of approximately 90 degrees to approximately 180 degrees.

34. The wide-area vacuum nozzle of claim 31, wherein the fitting is attached to the body between the first juncture and the second juncture and adjacent to a bend formed in the trailing edge.

35. The wide-area vacuum nozzle of claim 21, further comprising a bracket assembly hingedly coupled to the body, and extending from the first surface at an angle.

36. The wide-area vacuum nozzle of claim 21, wherein a distance between the first juncture and the second juncture is in a range of approximately 10 inches to approximately 30 inches.

37. A wide-area vacuum nozzle and bracket assembly for coupling to a vacuum cleaner tank, the assembly comprising:

a nozzle having a flat body with a first surface, a second surface, a leading edge, and a trailing edge, the leading edge and the trailing edge at least partially defining an outer periphery of the body, the outer periphery including a first juncture and a second juncture disposed between the leading edge and the trailing edge;

an aperture disposed between the leading edge and the trailing edge and extending through the first surface and second surface of the body;

a bracket assembly including a bracket having a first end and a second end, the first end hingedly coupled to the nozzle and the second end spaced away from the nozzle, wherein the bracket is oriented at an angle relative to the body of the nozzle;

a fitting sealably coupled to the first surface of the body and surrounding the aperture formed in the first surface;

a hose connector having a first end and a second end, the first end fluidly coupled to the fitting; and a bracket fitting coupled to the second end of the bracket and coupled to the second end of the hose connector, the bracket fitting defining an opening sized to receive the hose connector.

38. The assembly of claim 37, wherein the bracket fitting is hingedly coupled to the second end of the bracket.

39. The assembly of claim 37, wherein the fitting is centered about a fitting axis and extends from the first surface of the body, the fitting axis disposed at an angle relative to the first surface of the body.

40. The assembly of claim 39, wherein the angle of the fitting axis is in a range of approximately 90 degrees to approximately 180 degrees relative to the first surface of the body.

41. The assembly of claim 37, wherein the fitting is adjacent to the trailing edge and attached to the body between the first juncture and the second juncture.

42. The assembly of claim 37, wherein the bracket assembly is removably coupled to the body.

43. The assembly of claim 37, further comprising a back wall operatively coupled to the trailing edge of the body and oriented perpendicularly relative to the body, the back wall extending beyond the second surface of the body and adapted to contact a cleaning surface.

44. The assembly of claim 43, wherein a material of the back wall is an ultra-high molecular weight polyethylene.

45. The wide-area vacuum nozzle of claim 43, wherein the back wall is at least one of (a)-(d): (a) rubber, (b) acetal, (c) Acrylonitrile-Butadiene-Styrene, and (d) brush material.

46. The assembly of claim 37, wherein the leading edge forms an arc extending between the first juncture and the second juncture, and the trailing edge defines a bend between the first juncture and the second juncture.

47. The assembly of claim 37, wherein the outer periphery of the body is a fan shape, wherein the aperture is positioned adjacent a bend of the trailing edge.

48. The assembly of claim 37, wherein the body is transparent.

49. A wide-area vacuum nozzle comprising:

a generally horizontal plate having a leading edge and a trailing edge, wherein (i) each of the trailing edge and leading edge have a midpoint, a left side, and a right side; (ii) a left intersection disposed between the left sides of the leading edge and trailing edge; and (iii) a right intersection disposed between the right sides of the leading edge and the trailing edge;

an aperture through the plate proximate to the midpoint of the trailing edge, wherein the aperture is adapted to connect to a vacuum source; and a wall operatively coupled to the trailing edge of the plate and oriented perpendicularly relative to the plate, the wall extending beyond a width of the leading edge of the plate;

wherein the aperture is (a) approximately equidistant from the left intersection and the right intersection, and (b) further than or equidistant from the midpoint of the leading edge as it is from the right intersection and left intersection.

50. The wide-area vacuum nozzle of claim 49, wherein the wall is a durable material having a relatively low coefficient of friction, the wall being adjacent the trailing edge of the plate.

51. The wide-area vacuum nozzle of claim 49, wherein the wall includes a first segment and a second segment connected to the first segment, wherein each of the first and second segments connects to form an angle near the midpoint of the trailing edge.

52. The wide-area vacuum nozzle of claim 49, wherein the plate is transparent.

53. The wide-area vacuum nozzle of claim 49, wherein the leading edge is generally arc-shaped.

* * * * *